US005123971A

United States Patent [19]

Hook

[11] Patent Number: 5,123,971

[45] Date of Patent: Jun. 23, 1992

[54] COLD REDUCED NON-AGING DEEP DRAWING STEEL AND METHOD FOR PRODUCING

[75] Inventor: Rollin E. Hook, Dayton, Ohio

[73] Assignee: Armco Steel Company, L.P., Middletown, Ohio

[21] Appl. No.: 720,966

[22] Filed: Jun. 25, 1991

Related U.S. Application Data

[63] Continuation-in-part of Ser. No. 690,142, Apr. 23, 1991, Pat. No. 5,102,472, which is a continuation of Ser. No. 415,817, Oct. 2, 1989, abandoned.

[51] Int. Cl.[5] ..... C21D 9/48; C22C 38/06

[52] U.S. Cl. ..... 148/546; 148/320; 148/603

[58] Field of Search ..... 148/12 C, 12 F, 320, 148/2

[56] References Cited

U.S. PATENT DOCUMENTS

| | | | |
|---|---|---|---|
| 3,798,076 | 3/1974 | Shimizu et al. | 148/12 |
| 3,959,029 | 5/1976 | Matsudo et al. | 148/12 |
| 4,116,729 | 9/1978 | Katon et al. | 148/111 |
| 4,145,235 | 3/1979 | Gondo et al. | 148/12 |
| 4,473,411 | 9/1984 | Hook et al. | 148/12 |
| 4,478,649 | 10/1984 | Akisue et al. | 148/12 |
| 4,627,881 | 12/1986 | Kawano et al. | 148/12 |
| 4,698,102 | 10/1987 | Maruoka et al. | 148/2 |

FOREIGN PATENT DOCUMENTS 102867 8/1977 Japan .

OTHER PUBLICATIONS

W. C. Leslie et al., Solution & Precipitation of Aluminum Nitride in Relation to the Structure of Low Carbon Steels, 1954, pp. 1470-1499, Trans. ASM.

G. Ludkovsky et al., Processing, Microstructure and Properties of HSLA Steels, Jun. 1-3, 1987, 4th International Steel Rolling Conference, The Science and Technology of Flat Rolling, vol. 1, France.

*Primary Examiner*—Deborah Yee

*Attorney, Agent, or Firm*—R. J. Bunyard; L. A. Fillnow; R. H. Johnson

[57] ABSTRACT

A cold reduced, non-aging, aluminum killed steel characterized by an elongated grain structure and having an $r_m$ value at least 1.8 produced from a slab having a reduced hot rolling temperature. A slab consisting essentially of ≦0.08% carbon, ≦0.1% acid sol. aluminum, ≦0.2% manganese, all percentages by weight, the balance iron and unavoidable impurities, is hot rolled to a sheet from a temperature less than 1260° C. Preferably, the slab is continuously cast from a melt consisting essentially of 0.03-0.08% acid sol. aluminum, 0.003-0.007% total nitrogen, <0.20% manganese, wherein % acid sol. aluminum × % total nitrogen is within the range of $1\times10^{-4}$ to $5\times10^{-4}$ and is hot rolled from a temperature of 1093°-1175° C. The hot rolled sheet is descaled, cold reduced, batch annealed and temper rolled. Preferably, the cold reduced sheet is annealed in the range of 538°-649° C. and the temper rolled sheet has a tensile strength of 29-32 kg/mm$^2$, a total elongation of at least 42% and an $r_m$ value of at least 2.0.

21 Claims, 11 Drawing Sheets

● 0.12Mn,0.04Al,0.004N

■ 0.22Mn,0.04Al,0.003N

○ 0.12Mn,0.08Al,0.008N

□ 0.22Mn,0.08Al,0.009N 0.07Al/0.008-0.009N
H.R.TIME=0.5-0.7MIN.

REHEAT TEMP.-C

● 1149C / 0.12Mn

○ 1260C / 0.12Mn

■ 1149C / 0.22Mn

□ 1260C / 0.22Mn 0.07Al/0.008-0.009N
H.R.TIME=0.5-0.7MIN.

REHEAT TEMP.-C

● 1149C / 0.12Mn

○ 1260C / 0.12Mn

■ 1149C / 0.22Mn

□ 1260C / 0.22Mn 0.07Al/0.008-0.009N
H.R.TIME=0.5-0.7MIN.

REHEAT TEMP.-C

● 1149C / 0.12Mn

○ 1260C / 0.12Mn

■ 1149C / 0.22Mn

□ 1260C / 0.22Mn 0.11-0.13Mn
1149C REHEAT TEMP.
B.A. 649C-4HRS.

● 0.5 MIN. H.R. TIME

□ 2 MIN. H.R. TIME

REHEAT TEMP.=1149C
H.R. TIME=4MIN.

× 0.22Mn,0.09Al,0.009N

● 0.11Mn,0.06Al,0.006N

▲ 0.12Mn,0.05Al,0.004N

△ 0.23Mn,0.05Al,0.004N

1149C REHEAT TEMP.
%Mn/H.R.TIME

○ 0.12—0.13Mn/0.5MIN.

● 0.22-0.23Mn/0.5MIN.

□ 0.12—0.13Mn/2MIN.

■ 0.22—0.23Mn/2MIN.

COLD REDUCED NON-AGING DEEP DRAWING STEEL AND METHOD FOR PRODUCING

BACKGROUND OF THE INVENTION

This is a continuation-in-part of copending application Ser. No. 07/690,142 filed on Apr. 23, 1991, now U.S. Pat. No. 5,102,472, which is continuation of Ser. No. 07/415,817 filed on Oct. 2, 1989, now abandoned.

This invention relates to a cold reduced, deep drawing, non-aging, aluminum killed steel. More particularly, the invention relates to low manganese, batch annealed steel produced from a slab having a reduced hot rolling temperature. The steel is characterized by an elongated grain structure and having a very high average plastic strain ratio.

It is well known deep drawing steels are characterized as requiring a very high average plastic strain ratio($r_m$) of 1.8 or more. Average plastic strain ratio is defined as $r_m=(r_{0°}+r_{90°}+2r_{45°})/4$. High $r_m$ values have been achieved by adding various carbide and/or nitride formers, e.g., Ti, Cb, Zr, B, and the like, to steel melt compositions. However, addition of these elements to a melt to produce deep drawing steel is undesirable because of the added alloy costs. It also is known aluminum killed steel having an equiaxed grain structure with similar high $r_m$ values can be produced by continuous annealing if aluminum nitride is precipitated prior to cold reduction. Batch annealed, aluminum killed steel having an elongated grain structure can develop $r_m$ values of about 1.8 by precipitating aluminum nitride during the slow heatup prior to the onset of recrystallization during annealing. Unlike for batch annealing, aluminum nitride will not precipitate prior to recrystallization during annealing to form high $r_m$ values because the heating rate is too rapid. Precipitation of aluminum nitride prior to cold reduction to produce high $r_m$ values for continuously annealed aluminum killed steel is accomplished by using a high coiling temperature after hot rolling or by reheating a relatively cold slab to a temperature insufficient to re-dissolve aluminum nitride precipitated during cooling of the slab following casting.

The following prior art discloses cold reduced, aluminum killed steel produced by continuous annealing. U.S. Pat. No. 4,145,235 discloses a process for producing a low manganese, aluminum killed steel having high $r_m$ values by hot coiling a sheet at a temperature no less than 735° C. after hot rolling. Values for $r_m$ up to 2.09 after continuous annealing are disclosed. U.S. Pat. No. 4,478,649 discloses a process for direct hot rolling a continuously cast aluminum killed steel slab without reheating the slab. The as-cast slab is hot rolled prior to the slab cooling to a temperature below $Ar_3$ thereby avoiding precipitation of aluminum nitride. Aluminum nitride is precipitated prior to continuous annealing by hot coiling the sheet at a temperature of at least 780° C. after hot rolling. U.S. Pat. No. 4,698,102 discloses using slab temperatures for aluminum killed steel less than 1240° C. so that aluminum nitride precipitated during cooling of the slab following casting is not re-dissolved prior to hot rolling. Coiling temperatures after hot rolling of 620°-710° C. are disclosed to precipitate any remaining solute nitrogen prior to continuous annealing. U.S. Pat. No. 4,116,729 discloses cooling a continuously cast aluminum killed steel slab to within the temperature range of 650° C. to $Ar_3$ for at least 20 minutes to precipitate aluminum nitride. The slab then is reheated to 950°-1150° C. for hot rolling without re-dissolving the aluminum nitride. Values for $r_m$ up to 1.6 after continuous annealing are disclosed. U.S. Pat. No. 4,627,881 discloses a process for producing high $r_m$ values in continuously annealed aluminum killed steel by controlling the nitrogen to no greater than 0.0025% and the phosphorus to no greater than 0.010% with the sum of phosphorus plus five times the nitrogen no greater than 0.020%. Slabs were reheated and hot rolled within the temperature range of 1050°-1200° C. The hot rolled sheet was coiled at a temperature of less than 650° C. Cold reduced, continuously annealed sheet had $r_m$ values up to 2.1. It also is known continuously annealed aluminum killed steel having high $r_m$ values can be produced by increasing the soluble aluminum in the melt. U.S. Pat. No. 3,798,076 discloses an aluminum killed steel having 0.13 to 0.33% soluble aluminum and $r_m$ values up to 1.91 after continuous annealing.

It is known aluminum killed steel having similar high $r_m$ values can be produced by batch annealing. U.S. Pat. No. 3,959,029 discloses using conventional slab hot rolling practice so as not to precipitate aluminum nitride, i.e., keep nitrogen in solution, prior to batch annealing. Values for $r_m$ up to 2.23 were disclosed for a non-aging, aluminum killed steel by decarburizing a cold reduced sheet during annealing to less than 0.01% carbon. U.S. Pat. No. 4,473,411 discloses a batch annealed aluminum killed steel having $r_m$ values up to 1.85. The sheet was produced from a slab using conventional (1260° C. slab drop-out temperature) hot rolling practice having 0.12-0.24% manganese that was hot rolled without precipitating aluminum nitride. The hot rolled sheet was cold reduced and its cold spot temperature carefully controlled during annealing to develop high $r_m$ values.

Addition of carbide and/or nitride forming elements to a melt to produce non-aging deep drawing steel is undesirable because of the alloy costs. Melt processing techniques, i.e., vacuum degassing, ladle stirring, fluxing, and the like, required to reduce residual carbon, nitrogen or phosphorus are expensive. Using elevated coiling temperatures to produce non-aging, deep drawing, aluminum killed steel is undesirable because of uneven cooling rates and the scale formed on the hot rolled sheet during cooling from the elevated coiling temperature is more difficult to remove. Special decarburizing annealing cycles to produce non-aging, deep drawing, aluminum killed steel is undesirable because of added costs. Accordingly, there remains a need for an inexpensive, non-aging, deep drawing, aluminum killed steel. More particularly, there remains a need for a batch annealed, aluminum killed steel having an $r_m$ value of 1.8 or more that can be produced using conventional processing or using processing that does not add, and preferably reduces, cost over that of conventional processing.

BRIEF SUMMARY OF THE INVENTION

This invention relates to a cold reduced, non-aging, recrystallization batch annealed steel characterized by an elongated grain structure having an $r_m$ value of at least 1.8 and a method of producing wherein the steel consists essentially of $\leqq 0.08\%$ carbon, $<0.1\%$ acid sol. aluminum, $\leqq 0.2\%$ manganese, all percentages by weight, the balance iron and unavoidable impurities, the steel produced from a slab hot rolled from a temperature less than about 1260° C. to a sheet having nitrogen in solution. More preferably, the steel consists essentially of carbon ≦0.05%, manganese <0.20%, acid sol. aluminum 0.03–0.08%, total nitrogen 0.003–0.007% wherein % acid sol. aluminum × % total nitrogen is no greater than about $5\times10^{-4}$. Most preferably, the steel has an $r_m$ value of at least 2.0 after being annealed at a temperature of 538°–649° C., consists essentially of manganese ≦0.16%, acid sol. aluminum 0.05–0.06%, total nitrogen 0.004–0.006% wherein % acid sol. aluminum × % total nitrogen is within the range of $2\times10^{-4}$ to $4\times10^{-4}$ and is produced from a continuously cast slab hot rolled from a temperature less than about 1175° C.

Principal objects of the invention include producing a non-aging, deep drawing, aluminum killed steel without using melt alloying additions or without degassing, stirring or fluxing the melt to reduce residual carbon, nitrogen, or phosphorus to very low amounts.

Another object of the invention includes producing a non-aging, deep drawing, aluminum killed steel without using an elevated coiling temperature after hot rolling.

A further object of the invention includes producing a non-aging, deep drawing, aluminum killed steel without using a special batch annealing cycle such as decarburization.

A feature of the invention includes a non-aging, cold reduced, recrystallization batch annealed steel sheet characterized by an elongated grain structure and an $r_m$ value of at least 1.8 consisting essentially of ≦0.08% carbon, ≦0.1% acid sol. aluminum, ≦0.20% manganese, all percentages by weight, the balance iron and unavoidable impurities, the sheet having been produced from a slab hot rolled from a temperature less than about 1260° C. to a sheet having nitrogen in solution.

Another feature of the invention includes a non-aging, cold reduced, recrystallization batch annealed steel sheet characterized by an elongated grain structure and an $r_m$ value of at least 2.0 consisting essentially of ≦0.05% carbon, 0.02–0.1% acid sol. aluminum, ≦0.20% manganese, all percentages by weight, the balance iron and unavoidable impurities, the sheet having been produced from a continuously cast slab hot rolled from a temperature less than about 1175° C. to a sheet having nitrogen in solution.

Another feature of the invention includes a non-aging, cold reduced, recrystallization batch annealed steel sheet characterized by an elongated grain structure and an $r_m$ value of at least 1.8 consisting essentially of ≦0.08% carbon, ≦0.2% manganese, ≧0.01 acid sol. wt. % aluminum and nitrogen as an impurity, wherein the product of % acid sol. aluminum and % total nitrogen is $\leqq 5\times10^{-4}$, all percentages by weight, the balance iron and unavoidable impurities, the sheet having been produced from a slab hot rolled from a temperature less than about 1260° C. to a sheet having nitrogen in solution.

Another feature of the invention includes a non-aging, cold reduced, recrystallization batch annealed steel sheet characterized by an elongated grain structure and an $r_m$ value of at least 2.0 consisting essentially of ≦0.05% carbon, 0.03–0.08% acid sol. aluminum, 0.003–0.007% total nitrogen, <0.20% manganese, wherein the product of % acid sol. aluminum and % total nitrogen is $\leqq 5\times10^{-4}$, all percentages by weight, the balance iron and unavoidable impurities, the sheet having been produced from a continuously cast slab hot rolled from a temperature less than about 1175° C. to a sheet having nitrogen in solution.

Another feature of the invention includes a non-aging, cold reduced, recrystallization batch annealed steel sheet characterized by an elongated grain structure and an $r_m$ value of at least 2.0 consisting essentially of ≦0.05% carbon, 0.05–0.06% acid sol. aluminum, 0.004–0.006% total nitrogen, ≦0.16% manganese, wherein the product of % acid sol. aluminum and % total nitrogen is within the range of $2\times10^{-4}$ to $4\times10^{-4}$, all percentages by weight, the balance iron and unavoidable impurities, the sheet having been produced from a continuously cast slab hot rolled from a temperature less than about 1175° C. to a sheet having nitrogen in solution.

Another feature of the invention includes a method of producing a steel sheet by providing a slab consisting essentially of ≦0.08% carbon, ≦0.1% acid sol. aluminum, ≦0.20% manganese, all percentages by weight, the balance iron and unavoidable impurities, hot rolling the slab having a temperature less than about 1260° C. to a sheet having nitrogen in solution, descaling the hot rolled sheet, cold reducing the descaled sheet, recrystallization batch annealing the cold reduced sheet wherein the annealed sheet is non-aging, characterized by having an elongated grain structure and an $r_m$ value of at least 1.8.

Another feature of the invention includes a method of producing a steel sheet by providing a melt consisting essentially of ≦0.08% carbon, ≦0.1% acid sol. aluminum, ≦0.20% manganese, all percentages by weight, the balance iron and unavoidable impurities, casting the melt into a slab having a thickness no greater than 50 mm, hot rolling the slab having a temperature less than about 1260° C. to a sheet having nitrogen in solution, descaling the hot rolled sheet, cold reducing the descaled sheet, recrystallization batch annealing the cold reduced sheet wherein the annealed sheet is non-aging, characterized by having an elongated grain structure and an $r_m$ value of at least 1.8.

Another feature of the invention includes a method of producing a steel sheet by providing a melt consisting essentially of ≦0.05% carbon, 0.02–0.1% acid sol. aluminum, ≦0.20% manganese, all percentages by weight, the balance iron and unavoidable impurities, casting the melt into a slab, hot rolling the slab having a temperature less than about 1175° C. to a sheet having nitrogen in solution, descaling the hot rolled sheet, cold reducing the descaled sheet, recrystallization batch annealing the cold reduced sheet wherein the annealed sheet is non-aging, characterized by an elongated grain structure and has an $r_m$ value of at least 2.0.

Another feature of the invention includes a method of producing a steel sheet by providing a slab consisting essentially of ≦0.08% carbon, ≦0.2% manganese, ≧0.01 acid sol. wt. % aluminum and nitrogen as an impurity, wherein the product of % acid sol. aluminum and % total nitrogen is $\leqq 5\times10^{-4}$, all percentages by weight, the balance iron and unavoidable impurities, hot rolling the slab having a temperature less than about 1260° C. to a sheet having nitrogen in solution, descaling the hot rolled sheet, cold reducing the descaled sheet, recrystallization batch annealing the cold reduced sheet wherein the annealed sheet is non-aging, characterized by having an elongated grain structure and an $r_m$ value of at least 1.8.

Another feature of the invention includes a method of producing a steel sheet by providing a melt consisting essentially of ≦0.05% carbon, 0.03–0.08% acid sol. aluminum, 0.003–0.007% total nitrogen, <0.20% manganese, wherein the product of % acid sol. aluminum and % total nitrogen is $\leqq 5\times10^{-4}$, all percentages by weight, the balance iron and unavoidable impurities, casting the melt into a slab, cooling the slab to a temperature below $Ar_3$ to precipitate aluminum nitride, reheating the slab to a temperature less than 1175° C. to redissolve the aluminum nitride, hot rolling the slab to a sheet having a finishing temperature at least equal to $Ar_3$ and a coiling temperature no greater than 593° C. wherein the hot rolled sheet has nitrogen in solution, descaling the hot rolled sheet, cold reducing the descaled sheet, recrystallization batch annealing the cold reduced sheet wherein the annealed sheet is non-aging, characterized by an elongated grain structure and an $r_m$ value of at least 2.0.

Another feature of the invention includes a method of producing a steel sheet by providing a melt consisting essentially of $\leqq$0.05% carbon, 0.05–0.06% acid sol. aluminum, 0.004–0.006% total nitrogen, <0.20% manganese, wherein the product of % acid sol. aluminum and % total nitrogen is in the range of $2\times10^{-4}$ to $4\times10^{-4}$, all percentages by weight, the balance iron and unavoidable impurities, casting the melt into a slab, cooling the slab to a temperature below $Ar_3$ to precipitate aluminum nitride, reheating the slab to a temperature less than 1175° C. to redissolve the aluminum nitride, hot rolling the slab to a sheet having a finishing temperature at least equal to $Ar_3$ and a coiling temperature no greater than 593° C. wherein the hot rolled sheet has nitrogen in solution, descaling the hot rolled sheet, cold reducing the descaled sheet, recrystallization batch annealing the cold reduced sheet wherein the annealed sheet is non-aging, characterized by an elongated grain structure and an $r_m$ value of at least 2.0.

Another feature of the invention includes a method of producing a steel sheet by providing a melt consisting essentially of $\leqq$0.05% carbon, 0.05–0.06% acid sol. aluminum, 0.004–0.006% total nitrogen, $\leqq$0.16% manganese, wherein the product of % acid sol. aluminum and % total nitrogen is in the range of $2\times10^{-4}$ to $4\times10^{-4}$, all percentages by weight, the balance iron and unavoidable impurities, casting the melt into a slab, cooling the slab to a temperature below $Ar_3$ to precipitate aluminum nitride, reheating the slab to a temperature of less than 1175° C. to redissolve the aluminum nitride, hot rolling the slab to a sheet having a finishing temperature at least equal to $Ar_3$ and a coiling temperature no greater than 593° C. wherein the hot rolled sheet has nitrogen in solution, descaling the hot rolled sheet, cold reducing the descaled sheet, recrystallization batch annealing the cold reduced sheet in the range of 538°–649° C. wherein the annealed sheet is non-aging, characterized by an elongated grain structure and an $r_m$ value of at least 2.0.

Advantages of the invention include a cold reduced, non-aging, recrystallization batch annealed, aluminum killed steel characterized by an elongated grain structure and an $r_m$ value of at least 1.8 produced by hot rolling a slab having reduced temperature thereby effecting savings in energy costs, improving yields and productivity and extending the life of a slab heating furnace. A further advantage of the invention includes producing the steel from thin continuously cast slabs. An additional advantage of the invention includes producing the steel using a reduced annealing temperature thereby effecting savings in annealing time and energy costs.

The above and other objects, features, and advantages of the invention will become apparent upon consideration of the detailed description.

DETAILED DESCRIPTION OF THE PREFERRED EMBODIMENT

Figure 1:
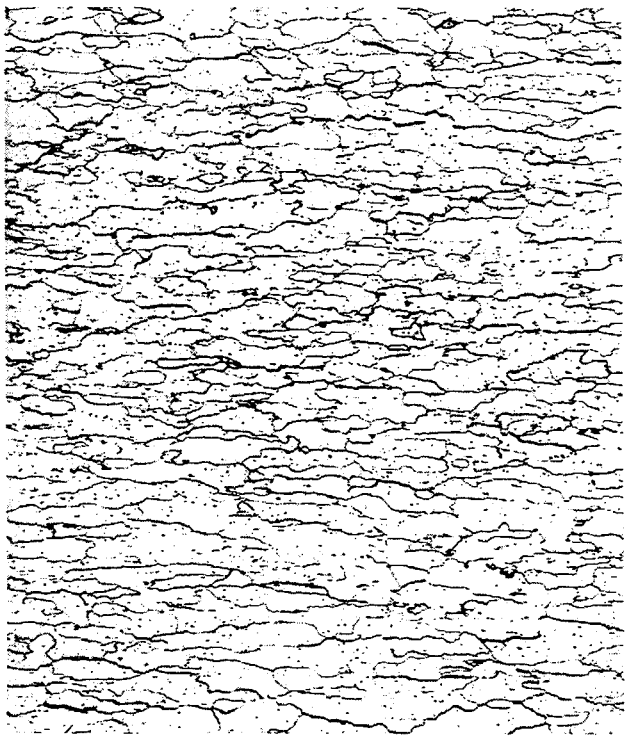
FIG. 1 is a photomicrograph at 100× magnification of the grain structure of a cold reduced, recrystallization batch annealed steel for one embodiment of the invention.

It will be understood by sheet is meant to include both cold reduced strip of indefinite length and cold reduced strip cut into definite lengths. It also will be understood the cold reduced sheets of the invention can be produced from slabs continuously cast from a melt or from ingots rolled on a slabbing mill.

The chemical composition of the steel in accordance with the present invention consists essentially of ≦0.08% carbon, <0.1% acid sol. aluminum, ≦0.2% manganese, all percentages by weight and the balance of the composition being iron and unavoidable impurities.

As discussed in more detail below, the compositions of aluminum, nitrogen and manganese individually are important for flexibility in processing and good drawability. An equally important consideration is the product of aluminum and nitrogen, i.e., % acid sol. aluminum × % total nitrogen. I have determined the compositions for aluminum and nitrogen be controlled so that their product preferably is no greater than $5\times10^{-4}$ and most preferably be within the range of $2\times10^{-4}$ to $4\times10^{-4}$. It is very important to control the aluminum nitrogen product when relatively long hot rolling times are required.

Manganese should be at least 0.05 wt. % to prevent hot shortness due to sulfur during hot rolling. If manganese is not low and exceeds about 0.24 wt. %, insufficient nitrogen would be retained in solution in hot rolled sheet produced from slabs having the reduced temperatures of the invention. To minimize slab and batch annealing temperatures and to maximize $r_m$ values, manganese preferably should be <0.20 wgt. % and most preferably ≦0.16 wt. %.

For an aluminum killed steel, at least 0.01 wt. % acid sol. aluminum is required to deoxidize the melt with the ratio of acid sol. aluminum to total nitrogen being at least 2:1. Maintaining this ratio insures that residual nitrogen exists as aluminum nitride so that recrystallization batch annealed steel is non-aging. For this reason, the acid sol. aluminum preferably should be at least 0.02 wt. %. Acid sol. aluminum should not exceed 0.1 wt. % because the annealed steel would have excessive hardness, diminished drawability and excess alloy cost. To minimize slab and batch annealing temperatures, to increase the elapsed times possible for hot rolling and to maximize $r_m$ values, acid sol. aluminum should be ≦0.08 wt. %. More preferably, acid sol. aluminum should be 0.03–0.08 wt. % and most preferably should be 0.05–0.06 wt. %.

Conventional residual amounts, i.e., impurities, of <0.01 wt. % total nitrogen, <0.02 wt. % phosphorus and <0.018 wt. % sulfur are acceptable. To maximize drawability, total nitrogen preferably should be <0.008 wt. %. More preferably, total nitrogen should be 0.003–0.007 wt. % and most preferably should be ≦0.004–0.006 wt. %.

Carbon should not exceed 0.08 wt. % because the batch annealed steel would have excessive hardness. Preferably, carbon is 0.03–0.05 wt. %.

Slabs of conventional thickness of 150–250 mm are hot rolled by gradually being reduced in thickness to about 30 mm by a series of roughing stands and further reduced to a sheet having a thickness of about 2.5 mm in a series of finishing stands. The hot rolled sheet then is coiled, descaled, cold reduced, and recrystallization batch annealed. Non-aging, aluminum killed steel produced by batch annealing requires nitrogen be retained in solid solution (not precipitated as aluminum nitride) in the hot rolled sheet after hot rolling. For slabs having cooled prior to hot rolling to a temperature below $Ar_3$, the slabs would have to be reheated to re-dissolve sufficient aluminum nitride so that the hot rolled sheet has solution nitrogen available for the formation of the recrystallization texture necessary for good $r_m$ values. For slabs directly hot rolled after continuous casting or from a slabbing mill, nitrogen has not precipitated as aluminum nitride if the slabs have not cooled to a temperature below $Ar_3$. Accordingly, it may not be necessary to reheat directly rolled slabs. Directly rolled slabs may not require as high a temperature as for slabs previously cooled to below $Ar_3$ since directly rolled slabs would not require redissolving aluminum nitride.

Aluminum nitride precipitation during the heating stage of a batch annealing cycle results in the formation of the desired strong {111} recrystallization texture which provides $r_m$ values required for good drawing performance. For steel cold reduced and recrystallization batch annealed, thermal-mechanical processing of slabs during hot rolling is conducted in a manner so as to minimize the amount of aluminum nitride in the hot rolled sheet. In a paper entitled SOLUTION AND PRECIPITATION OF ALUMINUM NITRIDE IN RELATION TO THE STRUCTURE OF LOW CARBON STEELS, Trans. ASM, 46 (1954), p. 1470–1499, by W. C. Leslie et al, incorporated herein by reference, it is disclosed the solution temperature of aluminum nitride during hot rolling is a function of the product of the weight percentages of acid soluble aluminum and total nitrogen present in the steel. Whether continuously cast or produced from ingots, slabs of conventional thickness that have cooled to below the $Ar_3$ are reheated prior to hot rolling to a temperature of at least 1260° C. for complete re-solution of the aluminum nitride formed during cooling of the slab after casting. Following reheating, thick slabs are hot rolled through the roughing stands where the temperature of the slabs falls from about 1260° C. to about 1040° C. over a period of about 3.25 to 3.75 minutes. The steel at about 1040° C. and having a thickness of 25–30 mm is further reduced to a thickness of about 2.5 mm by passing through a multi-stand finishing mill. The steel temperature falls from about 1040° C. to a sheet exit temperature (finishing temperature) as low as about 870° C. over a period of about 10 sec. Slabs preferably are processed to have a finishing temperature of at least 870° C. to not only avoid aluminum nitride precipitation but also control grain size. Coiling temperature also is controlled to minimize aluminum nitride precipitation. On exiting the finishing mill, the sheet is water quenched to a temperature less than 650° C., more preferably to less than 593° C., and most preferably to 566° C. before being wrapped into a coil. This is a suitable temperature from which to initiate the long time process of cooling the hot rolled sheet in coiled form and still avoid the precipitation of an undue amount of aluminum nitride. Thus, much of the nitrogen is retained in solution in the hot rolled sheet prior to cold reduction. Elevated coiling temperatures above 700° C. result in excessive aluminum nitride precipitation virtually guaranteeing failure to obtain high $r_m$ values and good deep drawing properties following cold reduction and batch annealing.

I have determined slabs do not have to be reheated to a high temperature of 1260° C. or more for hot rolling to obtain high $r_m$ values after batch annealing if manganese is lowered and aluminum and nitrogen is controlled. Slabs preferably are reheated to and hot rolled from a temperature less than 1175° C. and most preferably from about 1149° C.

By way of example, aluminum killed steels were prepared in the laboratory by vacuum melting. Steels A–E were cast into slab ingots 28.6 mm thick, 102 mm wide, and 178 mm long and cooled to ambient. Four slabs for each steel composition were reheated from ambient temperature to 1093° C., 1149° C., 1204° C., and 1260° C. for hot rolling. The residence time of the slabs in the heating furnace was one hour. The slabs were hot rolled to sheets having a thickness of 3.6 mm in about 0.5 minute, had a finishing temperature of 927° C., were water cooled to 566° C. to simulate a coiling temperature and then slowly furnace cooled to ambient. The hot rolled sheets then were descaled by pickling and cold reduced 70% to a thickness of 1.07 mm. The cold reduced sheets were heated at a rate of 28° C./hr (simulating batch annealing) to a temperature of 649° C., were soaked at this temperature for 4 hours and then cooled at a rate of 28° C./hr. The annealed sheets were temper rolled 1%. The compositions by weight percent and $r_m$ values of the temper rolled sheets for steels A–E are shown in Table 1.

TABLE 1

| STEEL | C | N | Al(acid sol) | S | Mn | CRBA $r_m$ Values* 1093° C. | 1149° C. | 1204° C. | 1260° C. |
|---|---|---|---|---|---|---|---|---|---|
| A | 0.046 | 0.007 | 0.07 | 0.008 | 0.07 | 1.32 | 2.48 | 2.26 | 1.78 |
| B | 0.044 | 0.007 | 0.07 | 0.007 | 0.10 | 1.26 | 2.38 | 1.91 | 2.45 |
| C | 0.036 | 0.008 | 0.07 | 0.008 | 0.13 | 1.21 | 2.39 | 1.89 | 1.94 |
| D | 0.046 | 0.007 | 0.07 | 0.008 | 0.16 | 1.19 | 2.30 | 1.93 | 1.89 |
| E | 0.042 | 0.007 | 0.08 | 0.009 | 0.22 | 1.09 | 1.44 | 1.71 | 1.79 |

*$r_m$ Values For C R Steels BA At 649° C.-4 Hours For Indicated Slab Reheat Temperatures And A Hot Rolling Coiling Temperature Of 566° C.

The results of Table 1 show that the steels for all manganese compositions had $r_m$ values of at least about 1.8 when using a conventional slab temperature of 1260° C. Steels A–D having manganese compositions less than 0.22 wt. % had very high $r_m$ values when the slabs were reheated to the reduced temperatures of 1149° C. and 1204° C. In fact, using a slab temperature of only 1149° C. resulted in exceptionally high $r_m$ values of 2.30 or more for steels A–D. However, further reducing the slab temperature to 1093° C. resulted in very low $r_m$ values of 1.32 or less for all manganese compositions indicative apparently of insufficient nitrogen being retained in solution in the hot rolled sheet prior to cold reduction. Steel E had $r_m$ values less than 1.8 when hot rolled from slabs having reduced temperatures of 1149° C. and 1204° C. Apparently, reducing the manganese content to 0.16 wt. % or less from 0.22 wt. % has a dramatic effect on the amount of nitrogen retained in solution in a hot rolled sheet rolled from a slab having a reduced temperature. By controlling the manganese content, apparently sufficient nitrogen was present in the hot rolled sheet for the formation of the recrystallization texture necessary for good $r_m$ values after batch annealing.

It is well known non-aging, cold reduced, batch annealed, aluminum killed steel is characterized by a grain structure having an elongation of 2.0 or more. Such a grain elongation is indicative that aluminum nitride precipitated during the slow heatup prior to the onset of recrystallization during annealing. It also is known the solution temperature of aluminum nitride is a function of the product of the weight percentages of nitrogen and aluminum in the steel. According to Leslie et al, the nitrogen and aluminum compositions of steels A–D would have suggested aluminum nitride "apparent" solution temperatures prior to hot rolling of 1284° C. or more.

TABLE 2

| STEEL | CRBA$r_m$Values* 1093° C. | 1149° C. | 1204° C. | 1260° C. |
|---|---|---|---|---|
| A | 1.30 | 1.28 | 1.41 | 1.35 |
| B | 1.21 | 1.26 | 1.30 | 1.29 |
| C | 1.21 | 1.28 | 1.25 | 1.27 |
| D | 1.13 | 1.21 | 1.21 | 1.21 |
| E | 1.11 | 1.15 | 1.13 | 1.15 |

*$r_m$ Values For C R Steels BA At 649° C.-4 Hours For Indicated Slab Reheat Temperatures And A Hot Rolling Coiling Temperature Of 704° C.

Figure 2:
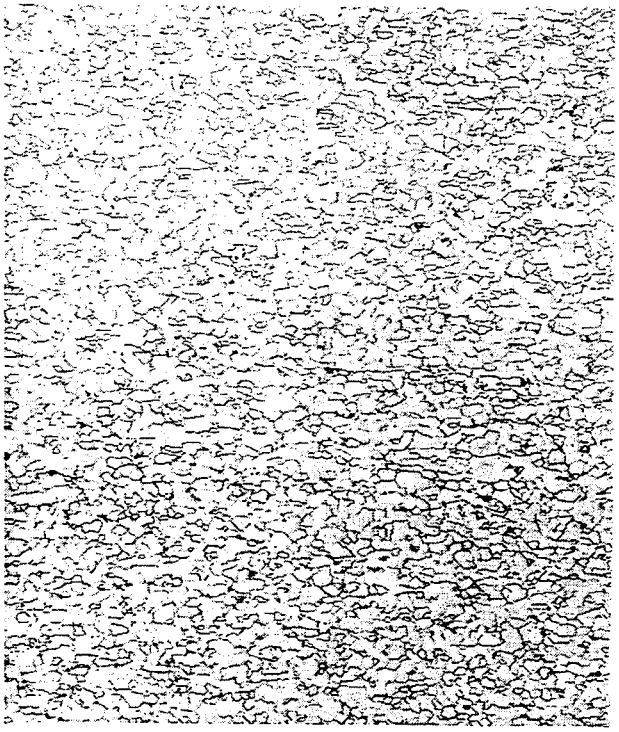
FIG. 2 is a photomicrograph at 100× magnification of the grain structure of a steel having the same composition as that of FIG. 1 but having a grain structure outside the invention.
Figure 3:
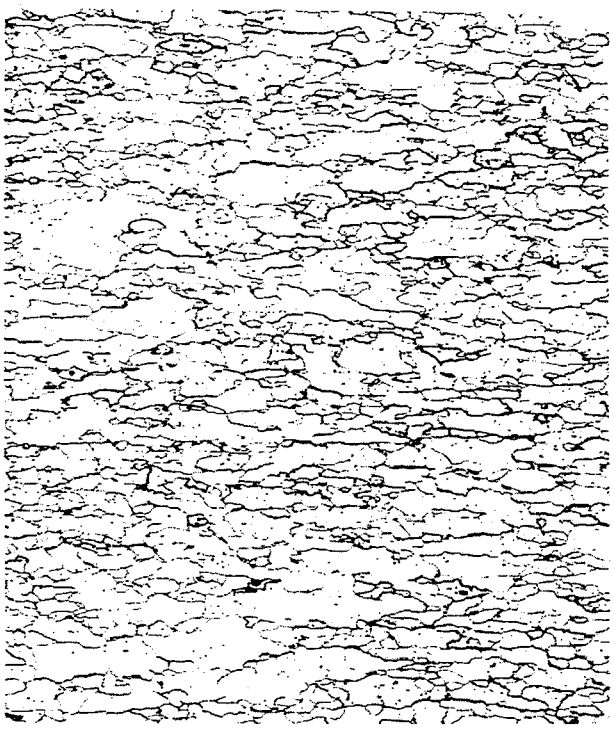
FIG. 3 is a photomicrograph at 100× magnification of the grain structure of a steel produced using the process of the invention but having an $r_m$ value outside the invention.
Figure 4:
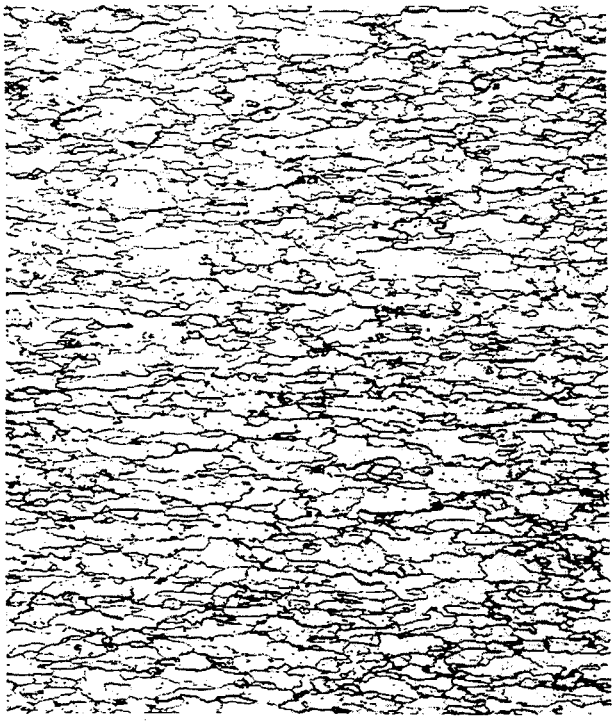
FIG. 4 is a photomicrograph at 100× magnification of the grain structure of a cold reduced, recrystallization batch annealed, aluminum killed steel having conventional composition and produced from a slab hot rolled from a conventional temperature.

However, the grain structures of steels A–D after cold reduction and batch annealing had very high elongations well in excess of conventional elongations, i.e., ≧2.0, for reduced slab temperatures of 1149° C. and 1204° C. For example, FIG. 1 shows a highly elongated grain structure for steel B having the $r_m$ value of 2.38 for the sheet that was cold reduced and batch annealed at 649° C. for four hours. The sheet was produced from the slab reheated to 1149° C. and having a simulated coiling temperature of 566° C. after hot rolling. FIG. 2 shows an equiaxed grain structure for steel B having the $r_m$ value of 1.26 and having the same processing as steel B in FIG. 1 except the slab was reheated to 1093° C. FIG. 2 demonstrates a slab temperature of 1093° C. apparently did not result in sufficient solute nitrogen in the hot rolled sheet to produce an elongated grain structure after cold reduction and batch annealing. FIG. 3 shows a conventional partially elongated grain structure for steel E having a low $r_m$ value of 1.44. Steel E in FIG. 3 had the same processing as steel B in FIG. 1. The only significant difference for steel E in FIG. 3 from that of steel B in FIG. 1 was that the steel in FIG. 3 had 0.22 wt. % manganese versus 0.10 wt. % for the steel in FIG. 1. It should be noted that not only was the elongation of the grain structure of the steel in FIG. 3 significantly less than that of the steel in FIG. 1 but also the grain structure of FIG. 3 includes a significant number of equiaxed grains. FIG. 4 shows a conventional elongated grain structure for steel E having the $r_m$ value of 1.79. Steel E in FIG. 4 was processed identically to steel B in FIG. 1 except the slab was reheated to 1260° C. The grain structure of the steel in FIG. 4 having a conventional hot rolling slab temperature had a grain elongation approaching that of the steel in FIG. 1. Unlike the grain structure for steel E in FIG. 3 using a reduced hot rolling temperature, the grain structure for steel E in FIG. 4 using the conventional slab hot rolling temperature had very few equiaxed grains. The remaining steels A, C and D having reduced slab temperatures of 1149° C. and 1204° C. had similar grain elongations to that shown in FIG. 1. Steels A, C and D having a reduced slab temperature of 1093° C. had grain structures similar to that shown in FIG. 2. Steels A, C and D having a conventional slab temperature of 1260° C. had grain elongations similar to that shown in FIG. 1. Leslie et al teach steels A-D should not have had sufficient solute nitrogen in sheets hot rolled from slabs at the reduced temperatures of 1149° C. and 1204° C., particularly 1149° C., to produce an elongated grain structure and high $r_m$ values after cold reduction and batch annealing. Contrary to these teachings, I determined that cold reduced and batch annealed steels A-D having manganese less than 0.22 wt. % and produced from sheets hot rolled from slabs reheated to temperatures of only 1149° C. and 1204° C. had grain elongations well in excess of conventional elongations. The reason for obtaining these elongated grain structures at reduced slab reheat temperatures is not known. Although not demonstrated analytically, a possible explanation for this unexpected result for steels A-D is that they apparently did have sufficient nitrogen retained in solution in the hot rolled sheet to from the classic elongated grain (and exceptionally high $r_m$ values) after cold reduction and simulated batch annealing.

In another experiment, steels A-E were processed identically to that for the example above reported in Table 1 except steels A-E were given an elevated simulated coiling temperature of 704° C. instead of 566° C. The $r_m$ values are shown in Table 2.

For all compositions and slab reheat temperatures, the $r_m$ values were diminished to 1.41 or less for these batch annealed sheets. This suggests the elevated simulated coiling temperature caused the nitrogen to be precipitated as aluminum nitride prior to cold reduction. Conversely, these results appear to confirm that aluminum nitride was in solution after hot rolling for steels A-D in Table 1 having the reduced slab temperatures of 1149° C. and 1204° C.

Figure 5:
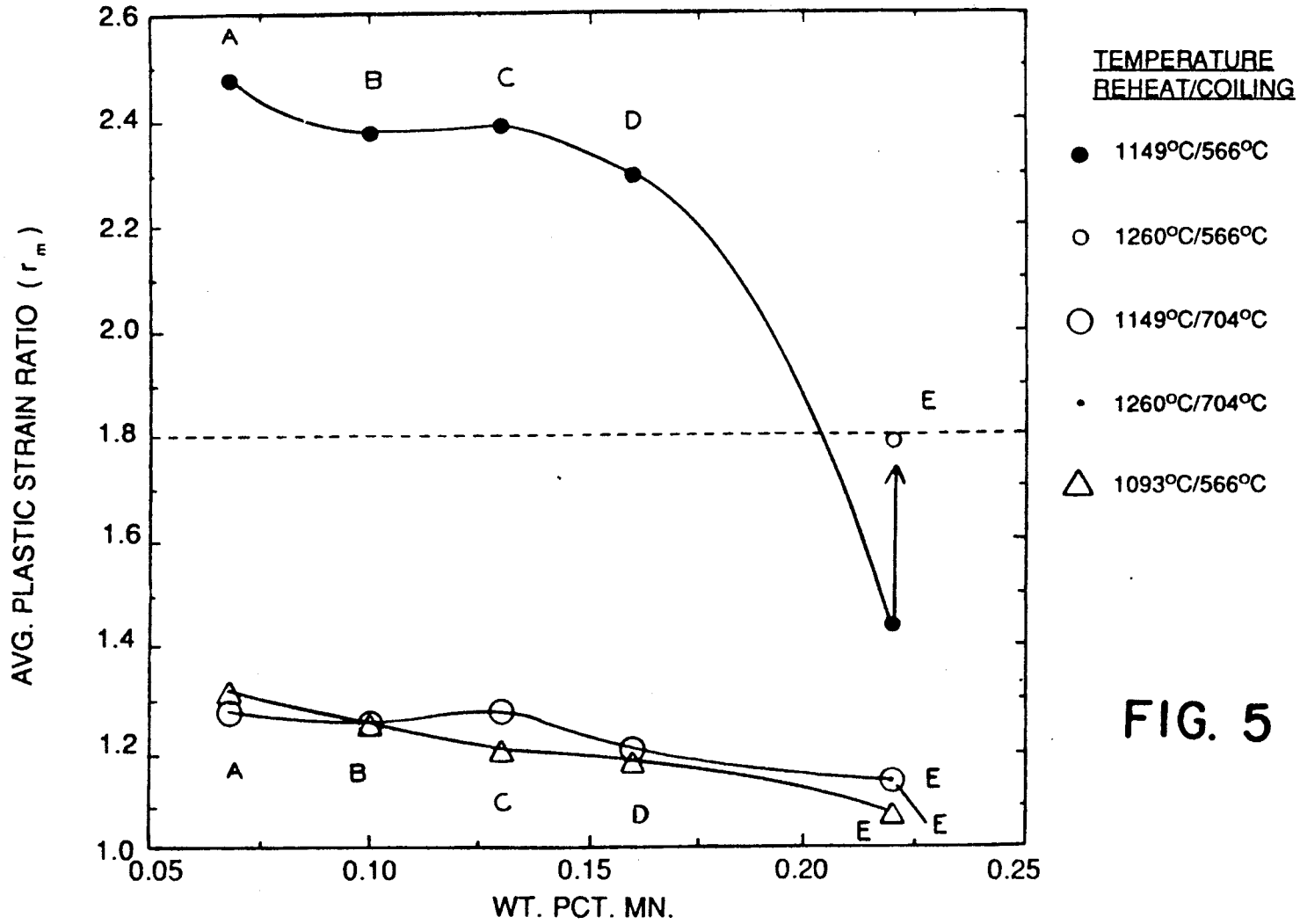
FIG. 5 is a graph of the $r_m$ values of cold reduced, batch annealed, aluminum killed steel as a function of manganese composition for different slab temperatures and different hot rolling coiling temperatures.

The $r_m$ values in Tables 1 and 2 are graphically shown in FIG. 5. Upper curve 10 shows the low manganese steels A-D having $r_m$ values well above 1.8 when cold reduced and batch annealed from sheet produced from slabs hot rolled at the reduced temperature of 1149° C. and having a coiling temperature of 566° C. The $r_m$ value for steel E having identical processing dropped to 1.44. When the slab temperature for steel E was increased to the conventional temperature of 1260° C., the $r_m$ value was increased to 1.79. When the slabs for steels A-E were heated to 1149° C. but had the simulated coiling temperature increased to 704° C., the $r_m$ values dropped to 1.28 or less as shown in curve 12. When the slabs for steels A-E were reheated to 1093° C. and had a coiling temperature of 566° C., all $r_m$ values were 1.30 or less as shown in bottom curve 14.

During additional experimental work, I determined slabs could be rolled from a temperature as low as 1093° C. and obtain $r_m$ values at least 1.8 after batch annealing by carefully controlling manganese, total nitrogen and acid sol. aluminum. Additional aluminum killed steels F-I were melted, cast into slab ingots, hot rolled to sheets in about 0.5 minute, pickled, cold reduced, batch annealed and then temper rolled identically to that for steels A-E in the example above reported in Table 1. The compositions by weight percent and $r_m$ values for steels F-I are shown in Table 3.

The results of Table 3 show that lowering manganese, total nitrogen and acid sol. aluminum had the effect of further reducing the slab temperature necessary prior to hot rolling and further increasing the $r_m$ value after batch annealing. A comparison of steels F and G shows steel G had a higher $r_m$ value at every slab temperature than the corresponding $r_m$ value of steel F.

TABLE 3

| | | | | | | CRBA $r_m$ Values* | | | |
|---|---|---|---|---|---|---|---|---|---|
| STEEL | C | N | Al(acid sol) | S | Mn | 1093° C. | 1149° C. | 1204° C. | 1260° C. |
| F | 0.042 | 0.009 | 0.08 | 0.007 | 0.22 | 1.21 | 1.76 | 1.65 | 1.68 |
| G | 0.039 | 0.003 | 0.04 | 0.008 | 0.22 | 1.78 | 2.31 | 1.95 | 1.77 |
| H | 0.044 | 0.008 | 0.08 | 0.008 | 0.12 | 1.34 | 2.07 | 1.71 | 1.80 |
| I | 0.041 | 0.004 | 0.04 | 0.007 | 0.12 | 1.88 | 2.25 | 2.26 | 2.28 |

*$r_m$ Values For Cold Reduced Steels Batch Annealed At 649° C.-4 Hours For Indicated Slab Reheat Temperatures And A Hot Rolling Coiling Temperature Of 566° C.

Similarly, a comparison of steels H and I shows steel I had a higher $r_m$ value at every slab temperature than the corresponding $r_m$ value of steel H as well. This clearly demonstrates the beneficial effect of increasing the $r_m$ values when reducing total nitrogen from about 0.009 to as low as 0.003 wt. % and reducing acid sol. aluminum from about 0.08 to as low as 0.04 wt. %. A similar comparison can be made demonstrating the beneficial effect of increasing the $r_m$ values when reducing manganese. Every $r_m$ value for steel H was higher than the corresponding $r_m$ value for steel F at each slab temperature. For steels I and G, every $r_m$ value for steel I was higher than the corresponding $r_m$ value for steel G at each slab temperature except for 1149° C. where the $r_m$ values were substantially the same. Finally, steel I having low compositions for each of acid sol. aluminum, total nitrogen and manganese had dramatically higher $r_m$ values at all slab temperatures (except 1149° C. for steel G) than the corresponding $r_m$ values for steels F, G and H which had higher acid sol. aluminum and total nitrogen and/or manganese. Furthermore, steel I demonstrated the slab temperature could be decreased at least about 170° C. (from 1260° C. or more to 1093° C. or less) without decreasing drawability of cold reduced, batch annealed sheet thereby reducing energy cost. Surprisingly, drawability of the steel sheet can be expected to improve substantially (higher $r_m$ values) as well with this decrease in cost.

Figure 6:
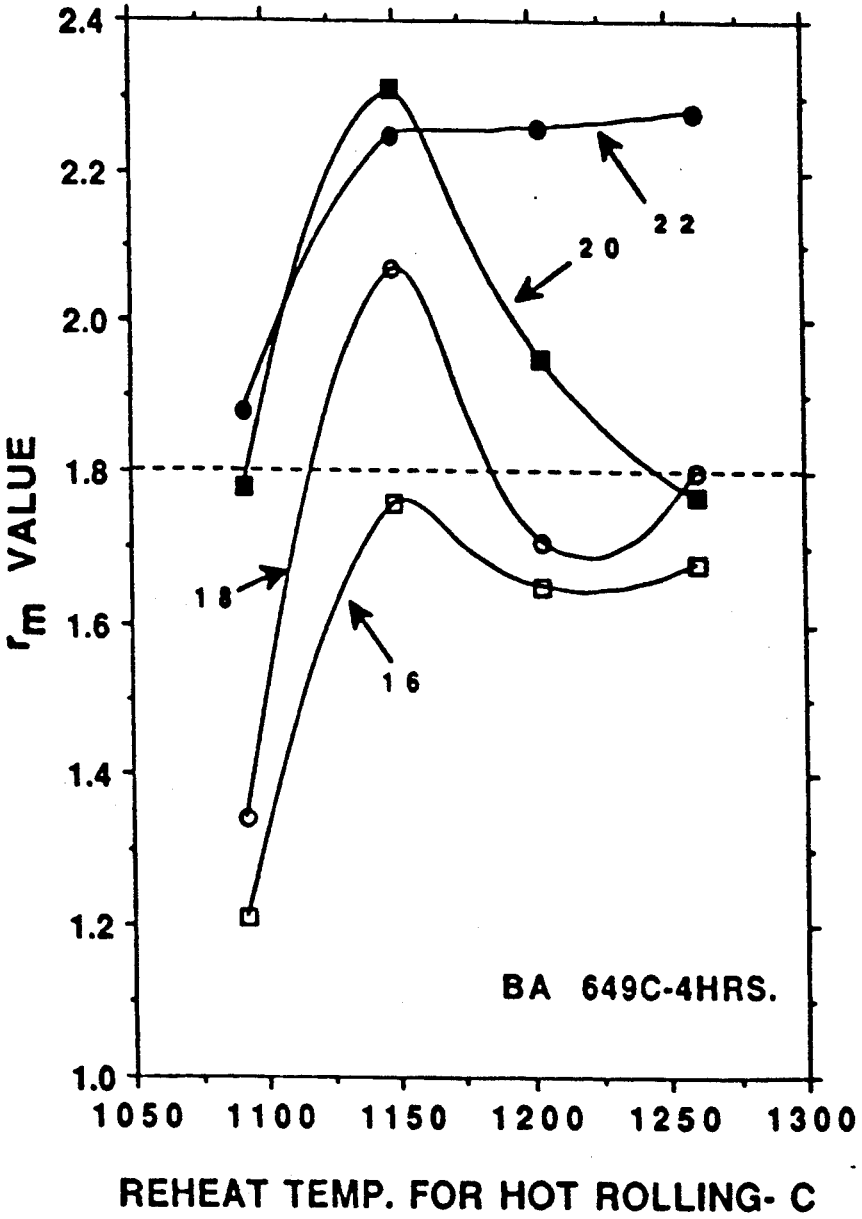
FIG. 6 is a graph of the $r_m$ values of cold reduced, batch annealed, aluminum killed steel as a function of slab temperature for different acid sol. aluminum, total nitrogen and manganese compositions.

The results from Table 3 are graphically shown in FIG. 6. Lower curve 16 for steel F had $r_m$ values generally below 1.8 for all temperatures. Curve 18 for steel H had an $r_m$ value above 1.8 for the reduced slab temperature of 1149° C. This demonstrates the beneficial effect of increasing the $r_m$ values and being able to decrease the required slab temperature when decreasing manganese from 0.22 wt. % to 0.12 wt. %. Curve 20 for steel G demonstrates the beneficial effect of increasing the $r_m$ values and being able to decrease the required slab temperature when decreasing acid sol. aluminum and total nitrogen. The $r_m$ value was at least 1.8 for a slab temperature as low as 1093° C. Finally, curve 22 for steel I had $r_m$ values as good as or better than any of the other three steel compositions demonstrating the beneficial effect of improving drawability and reducing energy costs during hot rolling when the composition of acid sol. aluminum, total nitrogen and manganese are carefully controlled. The optimum slab temperature was 1149° C. Unlike none of the results reported in Table 1, steels G and I having relatively low acid sol. aluminum and total nitrogen had $r_m$ values of about 1.8 or more even when the slabs were reheated to only 1093° C.

Values for $r_m$ also were evaluated as a function of annealing temperature. By way of further example, aluminum killed steels J–Q were prepared and their compositions by weight percent are shown in Table 4.

TABLE 4

| STEEL | C | N | AL(acid sol.) | S | MN |
|---|---|---|---|---|---|
| J | 0.042 | 0.008 | 0.07 | 0.009 | 0.12 |
| K | 0.043 | 0.009 | 0.07 | 0.009 | 0.12 |
| L | 0.044 | 0.009 | 0.07 | 0.009 | 0.12 |
| M | 0.042 | 0.009 | 0.07 | 0.009 | 0.12 |
| N | 0.038 | 0.009 | 0.07 | 0.007 | 0.22 |
| O | 0.039 | 0.008 | 0.07 | 0.007 | 0.22 |
| P | 0.038 | 0.009 | 0.07 | 0.008 | 0.22 |
| Q | 0.038 | 0.009 | 0.07 | 0.007 | 0.22 |

aluminum killed steel. Curve 26 for steels L and M hot rolled with a conventional slab temperature of 1260° C. had improved $r_m$ values demonstrating the beneficial effect of very low manganese of 0.12 wt. %. Curve 24 for steels J and K had good $r_m$ values, i.e., $\geqq 2.0$, when hot rolled with a reduced slab temperature of 1149° C. Even more surprising was that the $r_m$ values for steels J and K hot rolled with a lower slab temperature were substantially higher than the $r_m$ values for steels L and M of the same composition but hot rolled from 1260° C. Aluminum killed steels having conventional manganese compositions and hot rolled from slab temperatures of 1260° C. or more generally require batch annealing temperatures in excess of 649° C. to develop conventional $r_m$ values and mechanical properties. Equally surprising was that steels J and K also had good $r_m$ values for an annealing temperature as low as 566° C. In addition to improving drawability and reducing energy costs during hot rolling, the invention can save energy cost and time during batch annealing as well.

TABLE 5

| STEEL | Slab Temp(°C.) | Anneal Temp (°C.) Time(hr) | $r_m$ Value | 0.2% Y.S. (kg/mm$^2$) | T.S. (kg/mm$^2$) | % Elong. |
|---|---|---|---|---|---|---|
| J | 1149 | 566-4 | 1.97 | 20.9 | 30.8 | 43.8 |
| J | 1149 | 593-4 | 2.34 | 20.7 | 30.2 | 43.8 |
| J | 1149 | 621-4 | 2.26 | 19.8 | 29.5 | 45.3 |
| J | 1149 | 649-4 | 2.41 | 17.9 | 28.8 | 48.5 |
| K | 1149 | 677-4 | 2.37 | 17.6 | 27.8 | 50.0 |
| K | 1149 | 704-4 | 2.42 | 16.6 | 26.9 | 48.0 |
| K | 1149 | 732-4 | 2.40 | 16.9 | 26.8 | 47.8 |
| L | 1260 | 566-4 | 1.76 | 23.6 | 35.2 | 31.5 |
| L | 1260 | 593-4 | 1.73 | 22.9 | 34.0 | 36.5 |
| L | 1260 | 621-4 | 1.94 | 18.2 | 30.6 | 42.3 |
| M | 1260 | 649-4 | 1.87 | 19.8 | 31.6 | 39.0 |
| M | 1260 | 677-4 | 2.01 | 19.7 | 31.2 | 41.8 |
| M | 1260 | 704-4 | 2.15 | 17.3 | 29.0 | 41.8 |
| M | 1260 | 732-4 | 2.01 | 18.3 | 29.3 | 45.0 |
| N | 1149 | 566-4 | 1.52 | 18.4 | 30.9 | 38.0 |
| N | 1149 | 593-4 | 1.38 | 20.7 | 30.7 | 41.0 |
| N | 1149 | 621-4 | 1.32 | 19.7 | 30.5 | 44.3 |
| N | 1149 | 649-4 | 1.41 | 18.2 | 29.7 | 46.3 |
| O | 1149 | 677-4 | 1.44 | 16.5 | 28.8 | 48.5 |
| O | 1149 | 704-4 | 1.64 | 17.0 | 27.9 | 44.5 |
| O | 1149 | 732-4 | 1.72 | 19.1 | 28.0 | 41.8 |
| P | 1260 | 566-4 | 1.47 | 27.2 | 37.2 | 34.0 |
| P | 1260 | 593-4 | 1.63 | 24.8 | 35.7 | 33.0 |
| P | 1260 | 621-4 | 1.59 | 23.6 | 34.2 | 38.5 |
| Q | 1260 | 649-4 | 1.68 | 22.9 | 33.0 | 41.5 |
| Q | 1260 | 677-4 | 1.73 | 18.0 | 31.0 | 43.0 |
| Q | 1260 | 704-4 | 1.56 | 19.1 | 29.9 | 42.5 |
| Q | 1260 | 732-4 | 1.79 | 17.9 | 29.3 | 49.8 |

Steels J–Q were cast into slab ingots, hot rolled to sheets, pickled, cold reduced, annealed and then temper rolled identically to that for steels A–E in the example above reported in Table 1. The slabs having hot rolling temperatures of 1149° C. were hot rolled in about 0.5 minute and the slabs having hot rolling temperatures of 1260° C. were hot rolled in 0.7 minute. Batch annealing temperatures of 566°–732° C. with a soak time of four hours were used. The $r_m$ values, yield strength, tensile strength and % total elongation after temper rolling are shown in Table 5 and graphically illustrated in FIGS. 7–9.

Figure 7:
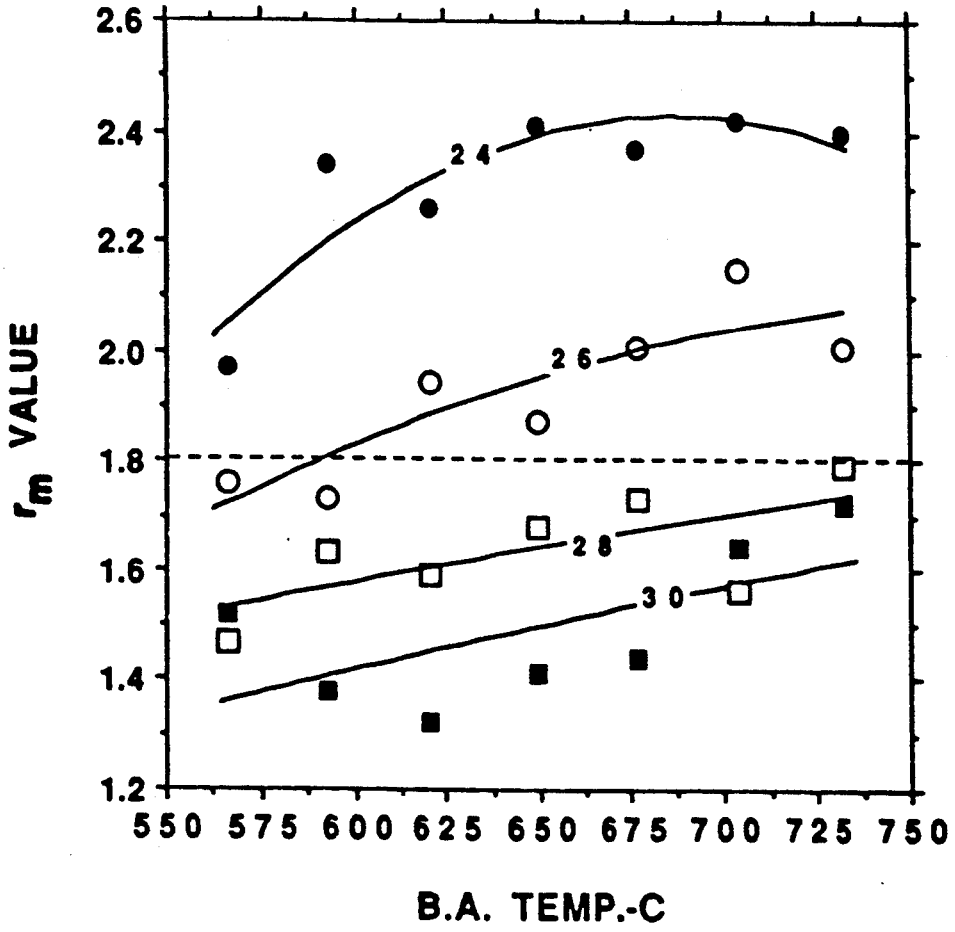
FIG. 7 is a graph of the $r_m$ values of cold reduced, aluminum killed steel as a function of batch annealing temperature, slab reheat temperature and manganese composition.
Figure 8:
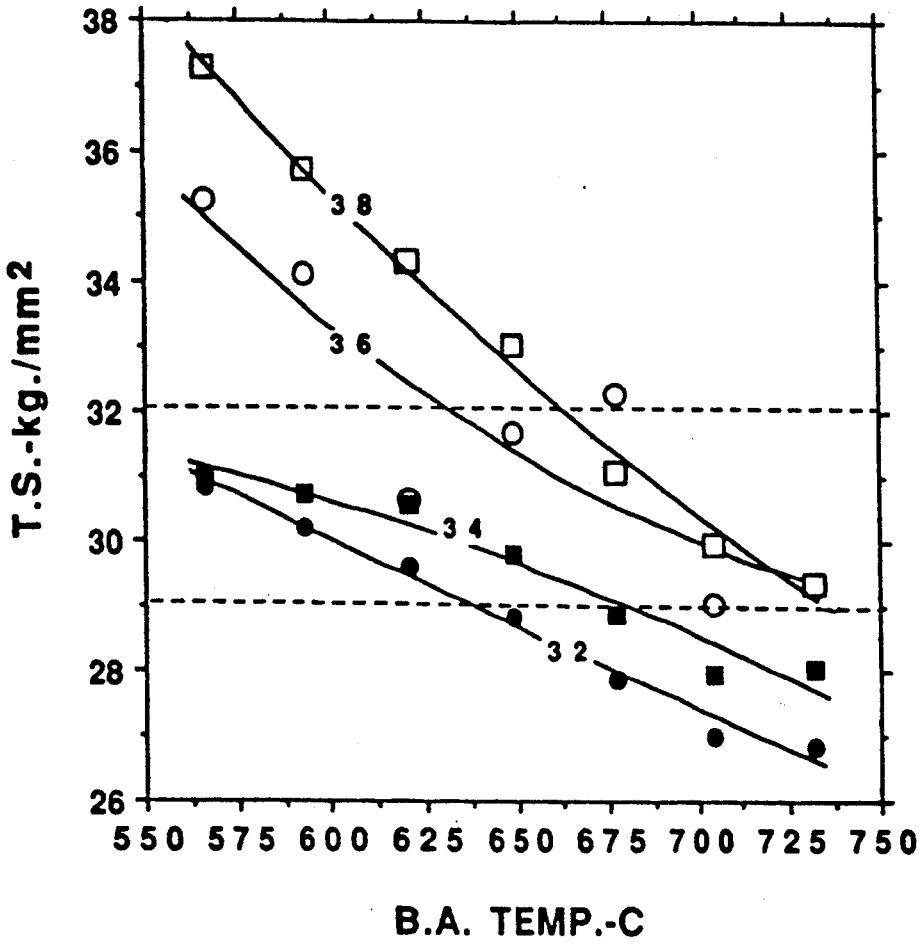
FIG. 8 is a graph of tensile strength of the steels of FIG. 7 as a function of batch annealing temperature, slab reheat temperature and manganese composition.

Curve 30 in FIG. 7 for steels N and O having relatively high acid sol. aluminum, total nitrogen and manganese of 0.07, 0.008–0.009 and 0.22 wt. % respectively conformed to the teachings of Leslie et al that using slab temperatures less than 1260° C. did not produce acceptable $r_m$ values for batch annealed, aluminum killed steel. Curve 28 for steels P and Q hot rolled with a conventional slab temperature of 1260° C. illustrates conventional $r_m$ values, i.e., generally $<1.8$, for batch annealed, Preferred tensile strength for deep drawing steel is no greater than about 32 kg/mm$^2$ with about 29–32 kg/mm$^2$ being the most preferred. Curves 32 and 34 in FIG. 8 are for steels J, K and N, O respectively having the reduced slab temperature of 1149° C. The annealing temperature preferably should be less than about 650° C. to obtain the desired tensile strength. In contrast, curves 36 and 38 for steels L, M and P, Q respectively having the conventional slab temperature of 1260° C. had increased tensile strengths at all annealing temperatures compared to those steels hot rolled from the slab temperature of 1149° C. Curves 32 and 34 illustrate that batch annealing temperature can be reduced for steels hot rolled from reduced slab temperatures.

Figure 9:
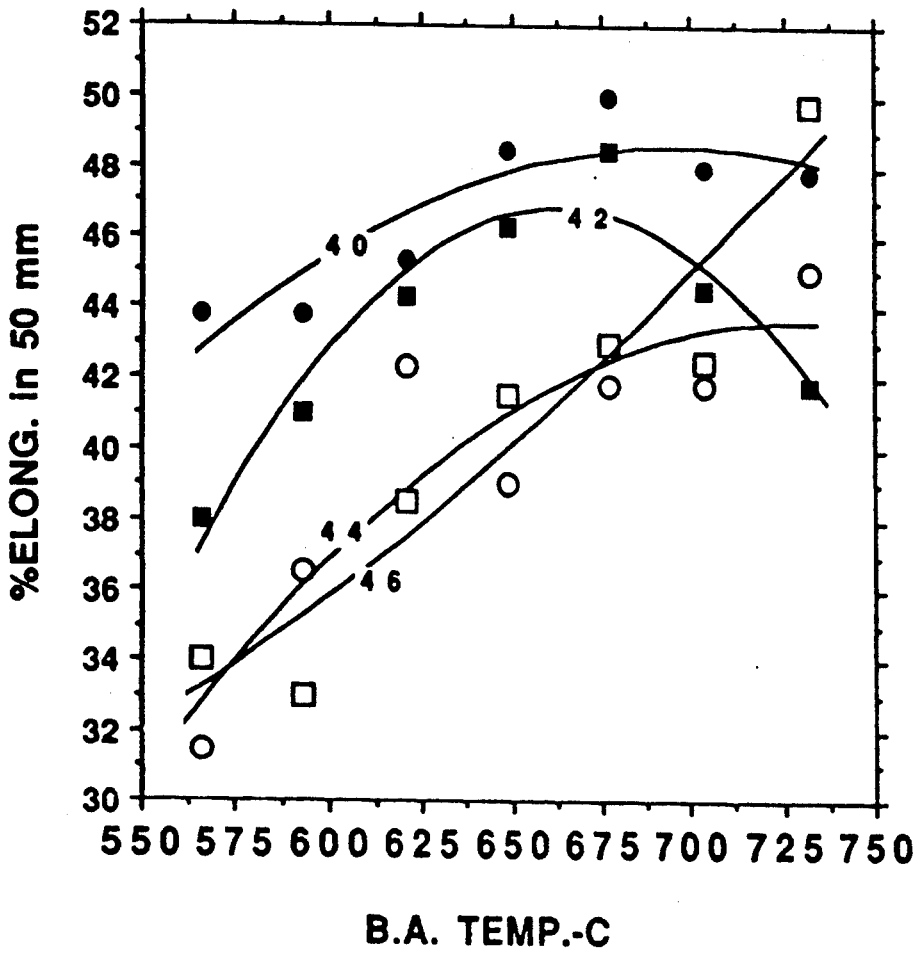
FIG. 9 is a graph of total elongation for the steels of FIG. 7 as a function of batch annealing temperature, slab reheat temperature and manganese composition.

Curves 40 and 42 in FIG. 9 correspond to steels J, K and N, O respectively and illustrate % total elongation as a function of batch annealing temperature. Curve 40 for steels J and K having very low manganese of 0.12 wt. % rolled from 1149° C. had excellent total elongations at all annealing temperatures while curve 42 for steels N and O having 0.22 wt. % Mn also rolled from 1149° C. had good total elongations at annealing temperatures of 600° C. or more. Curves 44 and 46 correspond to steels L, M and P, Q respectively rolled from 1260° C. Steels L, M and P, Q had poor total elongations at annealing temperatures less than 650° C.

In the laboratory experiments referred to above, the total hot rolling time was a short 0.5 minute for steels having reduced slab temperatures. By total hot rolling time is meant the elapsed time necessary for rolling a slab through any roughing stands present in a hot rolling mill and rolling through the finishing stands. Conventional hot strip mills generally require long rolling times of about four minutes or more for slabs having thicknesses of 200 mm or more. In another experiment, $r_m$ values were determined as a function of total hot rolling time and aluminum and nitrogen content. Steels R–BB were cast into slab ingots, hot rolled to sheets, pickled, cold reduced, batch annealed and then temper rolled in a manner identical to that for the example above reported in Table 1 except hot rolling times of about 0.5, 2 and 4 minutes were used. The slab ingots were reheated from ambient in a furnace to 1149° C. and held for one hour and then hot rolled to sheets having a thickness of 3.6 mm in three rolling passes. Steels hot rolled in 0.5 minute were held after the second pass until the temperature dropped to 949°–943° C. before completing the third pass. The finishing temperature after the third pass was 904° C. The steels immediately were water cooled and then slowly furnace cooled from 566° C. to ambient. Steels hot rolled in about 2 minutes were processed similar to the previous procedure except the steels were held for 80 seconds in a furnace maintained at 982° C. after the second pass. Steels rolled in about 4 minutes were hot rolled similar to the previous procedure except the steels were held for 200 seconds in the furnace maintained at 982° C. after the second pass. Compositions by weight percent, the aluminum nitrogen product and the calculated fraction of aluminum nitride dissolved in the slabs at the reheat temperature of 1149° C., and mechanical properties for steels R–BB are shown in Table 6. Aluminum and nitrogen compositions having three and four significant digits respectively were used for calculating the aluminum nitrogen products and fraction of aluminum nitride dissolved at 1149° C. even though aluminum and nitrogen compositions having only two and three significant digits respectively are reported in the tables herein. The $r_m$ values, tensile strength (TS) and total elongations (% Elong.) are for the steels after cold rolling 70%, batch annealing and temper rolling.

TABLE 6

| | | | | Calc.** | | | B. A. 649° C.-4 Hrs | | |
|---|---|---|---|---|---|---|---|---|---|
| Steel* | Mn | Al (acid sol.) | N(total) | Fract. AlN Dissolved at 1149° C. | [% Al] [% N] × 10,000 | Time min. | $r_m$ | T.S. Kg mm$^2$ | % Elong |
| R | 0.22 | 0.09 | 0.009 | 0.29 | 7.40 | 0.5 | 1.83 | — | — |
| | | | | 0.29 | 7.48 | 2 | 1.27 | — | — |
| | | | | 0.28 | 7.74 | 4 | 1.25 | 31.3 | 47.8 |
| S | 0.12 | 0.07 | 0.009 | 0.35 | 6.25 | 0.5 | 2.20 | — | — |
| | | | | 0.34 | 6.67 | 2 | 1.46 | — | — |
| | | | | 0.33 | 6.79 | 4 | 1.36 | — | — |
| T | 0.13 | 0.08 | 0.006 | 0.41 | 5.25 | 0.5 | 2.43 | — | — |
| | | | | 0.39 | 5.17 | 2 | 2.01 | — | — |
| | | | | 0.41 | 4.92 | 4 | 2.00 | — | — |
| U | 0.13 | 0.07 | 0.007 | 0.49 | 4.23 | 0.5 | 2.57 | — | — |
| | | | | 0.48 | 4.36 | 2 | 2.05 | — | — |
| V | 0.11 | 0.06 | 0.006 | 0.57 | 3.60 | 0.5 | 2.36 | — | — |
| | | | | 0.55 | 3.72 | 2 | 2.55 | — | — |
| | | | | 0.54 | 3.84 | 4 | 2.38 | — | — |
| W | 0.12 | 0.06 | 0.005 | 0.67 | 2.93 | 0.5 | 2.74 | — | — |
| | | | | 0.67 | 2.91 | 2 | 2.72 | — | — |
| | | | | 0.65 | 3.05 | 4 | 2.40 | — | — |
| X | 0.12 | 0.05 | 0.004 | 0.92 | 2.13 | 0.5 | 2.51 | — | — |
| | | | | 0.90 | 2.23 | 2 | 2.47 | — | — |
| | | | | 0.96 | 2.07 | 4 | 2.61 | — | — |
| Y | 0.23 | 0.05 | 0.004 | 0.88 | 2.17 | 0.5 | 1.98 | — | — |
| | | | | 0.86 | 2.23 | 2 | 1.90 | — | — |
| | | | | 0.92 | 2.07 | 4 | 2.04 | — | — |
| Z | 0.13 | 0.07 | 0.003 | 1.00 | 2.03 | 0.5 | 1.91 | — | — |
| | | | | 1.00 | 1.96 | 2 | 1.95 | — | — |
| | | | | 1.00 | 1.89 | 4 | 2.00 | — | — |
| AA | 0.12 | 0.04 | 0.003 | 1.00 | 1.22 | 0.5 | 1.89 | — | — |
| | | | | 1.00 | 1.25 | 2 | 1.99 | — | — |
| | | | | 1.00 | 1.20 | 4 | 2.10 | — | — |
| BB | 0.12 | 0.04 | 0.003 | 1.00 | 1.22 | 0.5 | 1.89 | — | — |
| | | | | 1.00 | 1.25 | 2 | 1.99 | — | — |
| | | | | 1.00 | 1.20 | 4 | 2.10 | — | — |
| H | 0.12 | 0.08 | 0.008 | 0.33 | 6.40 | 0.5 | 2.07 | — | — |
| C | 0.13 | 0.07 | 0.008 | 0.37 | 5.84 | 0.5 | 2.41 | — | — |
| J | 0.12 | 0.07 | 0.008 | 0.38 | 5.71 | 0.5 | 2.41 | 28.8 | 48.5 |
| I | 0.12 | 0.04 | 0.004 | 1.00 | 1.36 | 0.5 | 2.25 | — | — |

| | B. A. 607° C.-4 Hrs | | | B. A. 566° C.-4 Hrs | | | B. A. 538° C.-4 Hrs | | |
|---|---|---|---|---|---|---|---|---|---|
| Steel* | $r_m$ | T. S. Kg mm$^2$ | % Elong | $r_m$ | T. S. Kg mm$^2$ | % Elong | $r_m$ | T. S. Kg mm$^2$ | % Elong |
| R | — | — | — | — | — | — | — | — | — |
| | — | — | — | — | — | — | — | — | — |
| | 1.15 | 33.3 | 44.8 | 1.04 | 33.7 | 42.5 | — | — | — |
| S | — | — | — | — | — | — | — | — | — |

TABLE 6-continued

| | | | | | | | | | |
|---|---|---|---|---|---|---|---|---|---|
| | — | — | — | — | — | — | — | — | — |
| | — | — | — | — | — | — | — | — | — |
| T | — | — | — | — | — | — | — | — | — |
| | — | — | — | — | — | — | — | — | — |
| | 1.78 | 29.8 | 47.5 | 1.57 | 31.3 | 48.0 | — | — | — |
| U | — | — | — | — | — | — | — | — | — |
| | 1.99 | 30.0 | 46.3 | 2.05 | 30.9 | 46.5 | — | — | — |
| V | — | — | — | — | — | — | — | — | — |
| | — | — | — | — | — | — | — | — | — |
| | 2.32 | 29.9 | 46.8 | 2.27 | 31.6 | 43.3 | 2.21 | 32.8 | 40.0 |
| W | — | — | — | — | — | — | — | — | — |
| | — | — | — | — | — | — | — | — | — |
| | 2.52 | 29.1 | 46.8 | 2.36 | 31.1 | 44.1 | 1.80 | 37.6 | 23.5 |
| X | — | — | — | — | — | — | — | — | — |
| | — | — | — | — | — | — | — | — | — |
| | 2.66 | 29.7 | 41.3 | 2.59 | 32 | 40.8 | 2.13 | 33.2 | 41.0 |
| Y | — | — | — | — | — | — | — | — | — |
| | — | — | — | — | — | — | — | — | — |
| | 1.81 | 31.4 | 44.3 | 1.69 | 33.2 | 41.5 | — | — | — |
| Z | — | — | — | — | — | — | — | — | — |
| | — | — | — | — | — | — | — | — | — |
| | 1.70 | 29.9 | 46.5 | 1.66 | 31.6 | 44.0 | — | — | — |
| AA | — | — | — | — | — | — | — | — | — |
| | — | — | — | — | — | — | — | — | — |
| | 1.94 | 30.2 | 47.3 | 1.19 | 38 | 31.5 | — | — | — |
| BB | — | — | — | — | — | — | — | — | — |
| | — | — | — | — | — | — | — | — | — |
| | 1.94 | 30.2 | 47.3 | 1.19 | 38.0 | 31.5 | — | — | — |
| H | — | — | — | — | — | — | — | — | — |
| C | — | — | — | — | — | — | — | — | — |
| J | — | — | — | 1.97 | 30.8 | 43.8 | — | — | — |
| I | — | — | — | — | — | — | — | — | — |

*% C and % S for steels R-BB were 0.04 and 0.007–0.009 respectively.
**Calculated from Leslie. et al., "Apparent" Solubility of AlN in Austinite.

Figure 10:
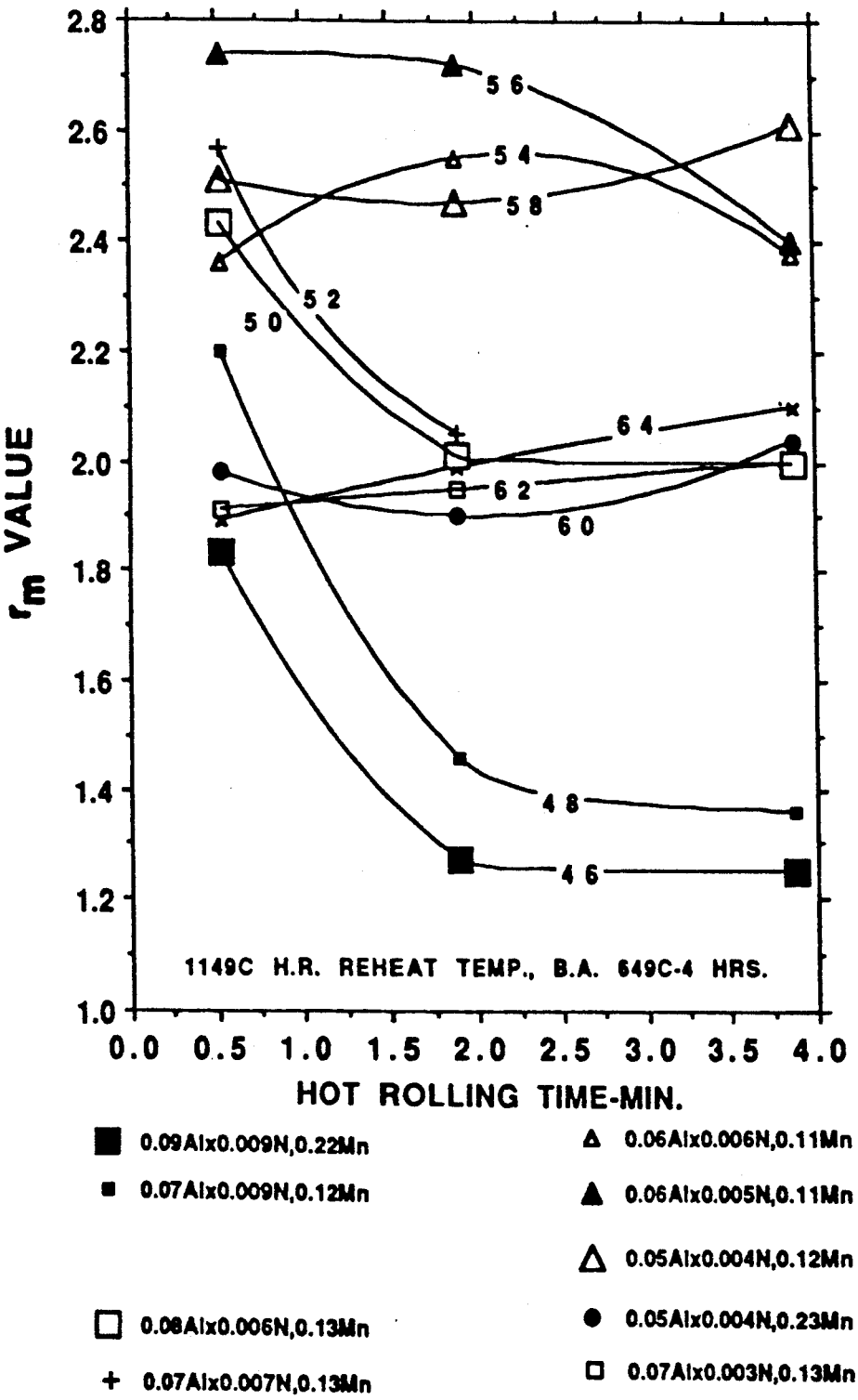
FIG. 10 is a graph of the $r_m$ values of cold reduced, batch annealed, aluminum killed steels as a function of hot rolling time for different acid sol. aluminum, total nitrogen and manganese compositions.

FIG. 10 graphically illustrates $r_m$ values as a function of hot rolling times for steels R–Z and BB hot rolled from slabs reheated to 1149° C. and batch annealed at 649° C. for four hours. A curve for steel AA was excluded from FIG. 10 since the $r_m$ values were essentially the same as those for steel BB. Curve 46 for steel R having relatively high concentrations for nitrogen, aluminum and manganese had low $r_m$ values for hot rolling times of two minutes or more. Curve 48 for steel S had a composition similar to steel R except steel S had very low manganese. Steel S had improved $r_m$ values at all hot rolling times but the $r_m$ values still were unacceptable at times of two minutes or more. Curve 50 for steel T had a composition similar to steel S except nitrogen was substantially reduced. Steel T had greatly improved $r_m$ values at all hot rolling times and were about 2.0 at times of two minutes or more. Curve 52 for steel U had a composition and $r_m$ values similar to steel T at hot rolling times of 0.5 and 2 minutes. Remaining steels V–Z and BB (curves 54–64 respectively) had low aluminum, nitrogen and manganese except steel Y had 0.23 wt. % manganese and steel Z had 0.07 wt. % acid sol. aluminum. Steels V–Z and BB had good $r_m$ values at all hot rolling times. Steel Y (curve 60) having 0.23 wt. % manganese had acceptable $r_m$ values at all hot rolling times and an $r_m$ value of about 2.0 for hot rolling times of 0.5 and 4 minutes. Curves 62 and 64 for steels Z and BB respectively having total nitrogen of 0.003 wt. % had acceptable $r_m$ values of about 1.9 or more at all rolling times. Surprisingly, steels Z and BB had the highest calculated fraction of aluminum nitride (100%) dissolved in the hot rolled sheet but did not have the highest $r_m$ values. Steels T, U, V and W had $r_m$ values higher than the $r_m$ values for steels Z and BB at all hot rolling times even though steels T, U, V and W had only about 40%, 49%, 56% and 67% respectively of aluminum nitride apparently dissolved at the 1149° C. reheat temperature prior to hot rolling. Steels T, U, V and W should have had more than 0.002 wt. % nitrogen retained in solution after hot rolling. This demonstrates for batch annealed, aluminum killed steel having low manganese that aluminum nitride need not be completely dissolved during slab reheating prior to hot rolling. The absolute amount of nitrogen retained in solution following hot rolling appears more important than the fraction retained. For optimum $r_m$ values, Table 6 and FIG. 10 demonstrate total nitrogen preferably should be 0.004–0.006 wt. % with at least about 0.002 wt. % nitrogen retained in solution following hot rolling.

As graphically demonstrated in FIG. 10, $r_m$ values for batch annealed, aluminum killed steels appear to be a function not only of nitrogen, aluminum and manganese but also total time for hot rolling as well. It appears important to control aluminum and nitrogen, even when manganese was controlled to less than 0.20 wt. %, when relatively long hot rolling times of two minutes or more are required when using slab temperatures less than 1260° C. to obtain $r_m$ values of at least about 1.8 after batch annealing. When hot rolling times are two minutes or more and manganese was controlled to $\leqq$0.16 wt. %, acid sol. aluminum can be as high as 0.03 wt. % with total nitrogen as high as 0.007 wt. % provided the product of % acid sol. aluminum and % total nitrogen was no greater than about $5\times10^{-4}$. When hot rolling times are two minutes or more and acid sol. aluminum and total nitrogen are controlled to no more than about 0.05 and 0.005 wt. % respectively, manganese can be at least 0.23 wt. %.

Figure 11:
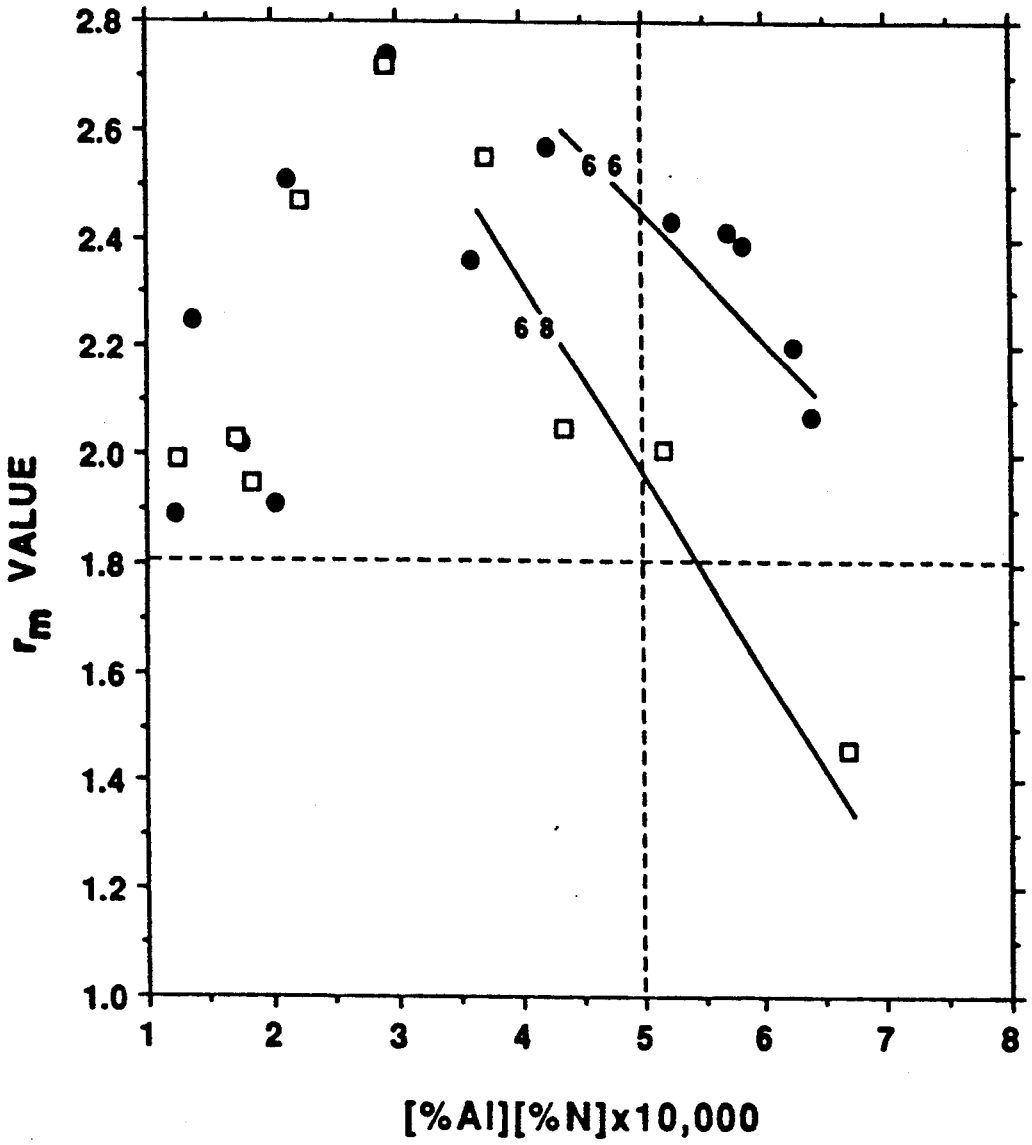
FIG. 11 is a graph of the $r_m$ values as a function of the product of acid sol. aluminum and total nitrogen for cold reduced, aluminum killed steel hot rolled from a slab having a temperature of 1149° C. at two different hot rolling times and batch annealed at 649° C. for four hours.

The relationship between aluminum and nitrogen to $r_m$ values also can be expressed as a function of the aluminum nitrogen product, i.e., wt. % acid sol. Al$\times$wt. % total N. Steels C, H, I, J, S, T, U, V, W, X, Z, AA and BB all had low manganese of 0.11–0.13 wt. %. Two samples of each of these steels, except steels C, H, I and J, were hot rolled at times of about 0.5 and 2 minutes and batch annealed at 649° C. for four hours. Steels C, H, I and J were hot rolled only at a time of about 0.5 minute. The $r_m$ values as a function of the aluminum nitrogen product are illustrated in FIG. 11. For both hot rolling times, the $r_m$ values increased with increasing aluminum nitrogen product with optimum $r_m$ values obtained at about an aluminum nitrogen product of about $3\times10^{-4}$. With a further increase in the aluminum nitrogen product, $r_m$ values decreased as illustrated by curve 66 for a rolling time of 0.5 minute and curve 68 for a rolling time of 2 minutes. The results for a rolling time of 4 minutes were substantially the same as for the 2 minute rolling time (see Table 6). Low manganese steels having a short hot rolling time of 0.5 minute had acceptable $r_m$ values for all aluminum nitrogen product values. For longer hot rolling times of 2 minutes, however, acceptable $r_m$ values of 1.8 or more were obtained so long as the aluminum nitrogen product did not exceed about $5\times10^{-4}$. For example, for steels having 0.11–0.13 wt. % manganese and having 0.08 wt. % acid sol. aluminum, total nitrogen should not exceed about 0.006 wt. %. Interestingly, the left hand portions of curves 66 and 68 both suggest the aluminum nitrogen product should not be less than about $1\times10^{-4}$. That is, for steels having 0.03 wt. % acid sol. aluminum, total nitrogen should be at least 0.004 wt. %. Alternatively, for steels having 0.003 wt. % or less total nitrogen, acid sol. aluminum should be at least 0.04 wt. %. In any case, total nitrogen should not be less than 0.003 wt. %. Otherwise, insufficient solute nitrogen would be available after hot rolling at the hot band stage to precipitate during heating in batch annealing following cold rolling. For optimum $r_m$ values, aluminum nitrogen product should be $2\times10^{-4}$ to $4\times10^{-4}$.

Figure 12:
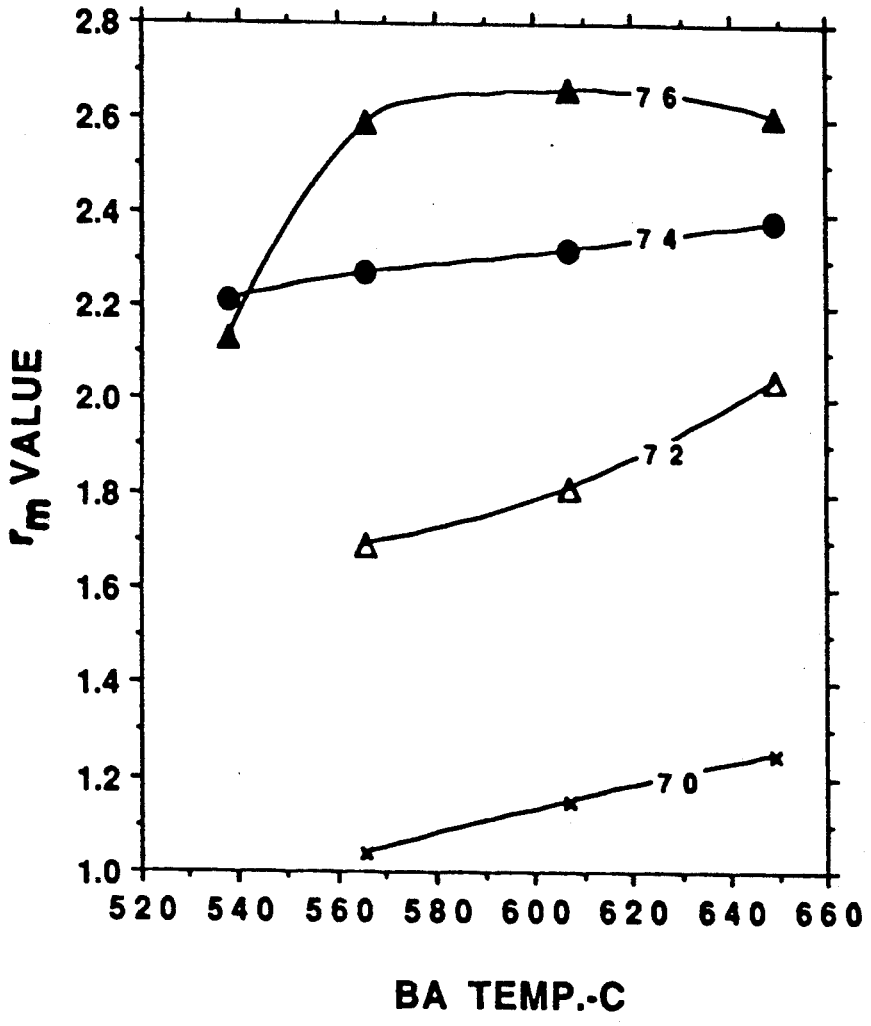
FIG. 12 is a graph for $r_m$ values of cold reduced, aluminum killed steel as a function of batch annealing temperature for different acid sol. aluminum, total nitrogen and manganese compositions when hot rolled from a slab having a temperature of 1149° C.

Steels R–BB hot rolled for four minutes from slabs reheated to 1149° C. were batch annealed at temperatures of 649° C., 607° C. and 566° C. Steels V, W and X also were batch annealed at 538° C. The $r_m$ values as a function of annealing temperature for steels R, V, X and Y are illustrated in FIG. 12. It does not appear steel R (curve 70) having relatively high concentrations for nitrogen, aluminum and manganese will develop good $r_m$ values at any annealing temperature when a long hot rolling time of four minutes is required. Steel Y (curve 72) having low nitrogen and aluminum but relatively high manganese of 0.23 wt. % developed good $r_m$ values at annealing temperatures of about 600° C. and higher for the four minute rolling time. Steels V and X (curves 74 and 76 respectively) having low nitrogen, aluminum and manganese developed excellent $r_m$ values at all annealing temperatures. Steels V and X surprisingly had excellent $r_m$ values at an annealing temperature of only 566° C. for the four minute rolling time. Steels V, W and X also were batch annealed at 538° C. for 8 hours instead of 4 hours. Steels V, W and X had acceptable $r_m$ values when batch annealed at 538° C. with steels V and X still having excellent $r_m$ values and mechanical properties. Steel W was not quite fully recrystallized after batch annealing at 538° C. While it had a good rm value of 1.8, the tensile properties of steel W were unaceptable.

Figure 13:
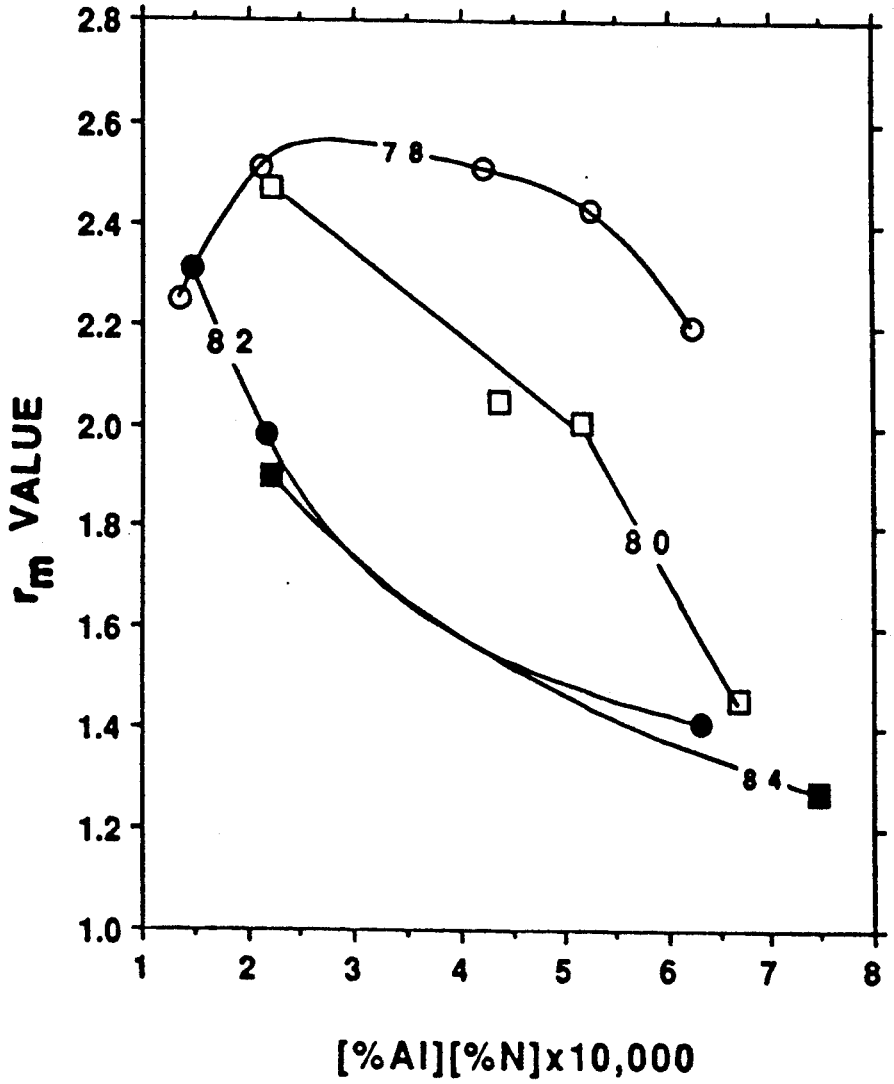
FIG. 13 is a graph for $r_m$ values of cold reduced, aluminum killed steel as a function of aluminum nitrogen product, manganese and hot rolling time for steels hot rolled from a slab having a temperature of about 1149° C. and annealed at 649° C.—4 hours.

To more clearly illustrate the interdependence between manganese, aluminum nitrogen product and hot rolling time for slabs rolled from temperatures less than 1260° C., the results of several of the steels described above are recast in Table 7. Table 7 shows the $r_m$ values following batch annealing at 649° C.—4 hours for those steels having either 0.12–0.13 or 0.22–0.23 wt. % manganese, aluminum nitrogen products in the range of about $1.4\times10^{-4}$ to $7.5\times10^{-4}$, hot rolled from a slab having a temperature of about 1149° C. and having a hot rolling time of either 0.5 or 2 minute. Table 7 was constructed by grouping steels at the two manganese compositions according to values of aluminum nitrogen product as close as possible to one another over the above cited range. The results are graphically illustrated in FIG. 13.

TABLE 7

| Steel | Mn | Al (acid sol.) | N(total) | [% Al] [% N] × 10,000 | H. R. Time 0.5 min. $r_m$ Value* | H. R. Time 2 min. $r_m$ Value* |
|---|---|---|---|---|---|---|
| S | 0.12 | 0.07 | 0.009 | 6.25 | 2.20 | — |
| N | 0.22 | 0.07 | 0.009 | 6.32 | 1.41 | — |
| T | 0.13 | 0.08 | 0.006 | 5.25 | 2.43 | — |
| T | 0.13 | 0.08 | 0.006 | 5.17 | — | 2.01 |
| U | 0.13 | 0.07 | 0.007 | 4.23 | 2.57 | — |
| U | 0.13 | 0.07 | 0.007 | 4.36 | — | 2.05 |
| X | 0.12 | 0.05 | 0.004 | 2.13 | 2.51 | — |
| Y | 0.23 | 0.05 | 0.004 | 2.17 | 1.98 | — |
| I | 0.12 | 0.04 | 0.004 | 1.37 | 2.25 | — |
| G | 0.22 | 0.04 | 0.003 | 1.47 | 2.31 | — |
| S | 0.12 | 0.07 | 0.009 | 6.67 | — | 1.46 |
| R | 0.22 | 0.09 | 0.009 | 7.48 | — | 1.27 |
| X | 0.12 | 0.05 | 0.004 | 2.23 | — | 2.47 |
| Y | 0.23 | 0.05 | 0.004 | 2.23 | — | 1.90 |

*Hot Rolled From 1149° C. And Batch Annealed 649° C.-4 Hours

Curve 78 demonstrates for a short rolling time of 0.5 minute and low manganese of ≦0.13 wt. %, the $r_m$ values are very high, i.e., ≧2.0, for aluminum nitrogen products over the range $1.4\times10^{-4}$ to $6.3\times10^{-4}$. Curve 80 demonstrates for a relatively long rolling time of 2 minutes and low manganese of ≦0.13 wt. %, the $r_m$ values also are very high up to an aluminum nitrogen product of about $5\times10^{-4}$. The $r_m$ value was substantially below 1.8 (steel S) when the aluminum nitrogen product exceeds about $5\times10^{-4}$. Curve 82 demonstrates for a rolling time of about 0.5 minute and relatively high manganese of 0.22–0.23 wt. %, the $r_m$ value was very low, e.g., 1.4, for steel N when the aluminum nitrogen product increased to about $6.3\times10^{-4}$. This was in direct contrast to steel S having the rolling time of about 0.5 minute, 0.12 wt. % Mn and a relatively high aluminum nitrogen product of about $6.3\times10^{-4}$ illustrated by curve 78. Curve 82 also demonstrates for the rolling time of about 0.5 minute, steels Y and G having relatively high 0.22–0.23 wt. % Mn and a low aluminum nitrogen product of about ≦$2.2\times10^{-4}$, the $r_m$ values still were very high but somewhat lower than the $r_m$ values for steels X and I having 0.12 wt. % Mn and the same aluminum nitrogen product. Curve 82 further demonstrates for the rolling time of about 0.5 minute, regardless of the manganese composition when the aluminum nitrogen was about $1.4\times10^{-4}$, the $r_m$ values are very high and essentially the same, e.g., 2.3. Comparing curve 84 for relatively high 0.22–0.23 wt. % Mn and the 2 minute rolling time to curve 82 for the same manganese but a 0.5 minute rolling time demonstrates there was little influence of rolling time on the $r_m$ values when the manganese was relatively high, i.e., ≧0.20 wt. %. In contrast, comparing curve 80 for ≦0.13 wt. % Mn and the 2 minute rolling time to curve 78 having the same manganese and the 0.5 minute rolling time demonstrates there was a significant influence of rolling time on the $r_m$ values when the manganese was very low, i.e., <0.20 wt. %.

TABLE 8

| Steel* | Mn | Al (acid sol.) | N(total) | Slab Reheat Temp °C. | H R Time min. | B. A. 649° C.-4 Hrs $r_m$ | T.S. Kg/mm² | % Elong | B. A. 607° C.-4 Hrs $r_m$ | T.S. Kg/mm² | % Elong | B. A. 566° C.-4 Hrs $r_m$ | T.S. Kg/mm² | % Elong |
|---|---|---|---|---|---|---|---|---|---|---|---|---|---|---|
| CC | 0.11 | 0.05 | 0.005 | 1149 | 4 | 2.80 | 28.6 | 45.0 | 2.73 | 30.3 | 40.3 | 2.58 | 32.3 | 39.0 |
| CC | 0.11 | 0.05 | 0.005 | 1204 | 4 | 2.76 | 28.7 | 42.8 | 2.64 | 30.8 | 41.3 | 2.48 | 32.4 | 37.5 |
| CC | 0.11 | 0.05 | 0.005 | 1260 | 4 | 2.57 | 29.5 | 40.5 | 2.62 | 30.8 | 45.0 | 2.63 | 32.5 | 35.5 |
| DD | 0.21 | 0.05 | 0.005 | 1149 | 4 | 2.02 | 30.1 | 47.5 | 1.92 | 32.4 | 46.5 | 1.81 | 35.5 | 37.8 |
| DD | 0.21 | 0.05 | 0.005 | 1204 | 4 | 1.94 | 30.7 | 45.0 | 1.76 | 32.6 | 41.8 | 1.78 | 34.8 | 38.3 |
| DD | 0.21 | 0.05 | 0.005 | 1260 | 4 | 1.95 | 31.1 | 42.8 | 1.91 | 33.2 | 41.3 | 1.79 | 35.5 | 37.8 |

*% C and % S for steels CC and DD were 0.04 and 0.009 respectively.

Even so, $r_m$ values were remarkably superior for steels having ≦0.13 wt. % Mn versus 0.22–0.23 wt. % Mn for a 2 minute rolling time over an aluminum nitrogen product range of about $2\times10^{-4}$ to $5\times10^{-4}$.

All the features of the invention are demonstrated in a final experiment wherein $r_m$ values were determined for a steel CC having optimum aluminum and nitrogen content of 0.05 wt. % and 0.005 wt. % respectively, optimum aluminum nitrogen product of about $2.5\times10^{-4}$, a conventional total hot rolling time of about four minutes and a low manganese composition of 0.11 wt. %. The $r_m$ values of steel CC are compared to the $r_m$ values of a steel DD having the same optimum composition except for relatively high manganese of 0.21 wt. %. Steels CC and DD were cast into slab ingots, hot rolled to sheets, pickled, cold reduced, batch annealed and then temper rolled in a manner identical to that for the example reported in Table 6 except only a hot rolling time of 4 minutes was used for slab reheat temperatures of 1149° C., 1204° C. and 1260° C. Samples for each steel were batch annealed at temperatures of 649° C., 607° C. and 566° C. for four hours. The results are shown in Table 8 and demonstrate $r_m$ value was not adversely effected using reduced slab reheat temperature or reduced annealing temperature. In fact, $r_m$ values for the reduced slab reheat temperature of 1149° C. generally equaled or exceeded the $r_m$ values for the conventional reheat temperature of 1260° C. for steels CC and DD. For the reduced annealing temperature of 566° C., the $r_m$ values were slightly less than the $r_m$ values for the annealing temperature of 649° C. As demonstrated above in Table 7, there is a clear interdependence between manganese and $r_m$ values. The $r_m$ values of low manganese steel CC exceeded the $r_m$ values for relatively high manganese steel DD at all annealing temperatures. Nevertheless, even for relatively high manganese of 0.21 wt. %, the $r_m$ values were still good, i.e., at least 1.8, using a reduced slab reheat temperature of 1149° C. and a reduced annealing temperature of 566° C. when aluminum, nitrogen and the aluminum nitrogen product all were carefully controlled.

Those skilled in the art will appreciate slabs having conventional thicknesses of 150–250 mm need an initial temperature of 1200° C. or more to be hot rolled to a thickness of about 2.5 mm and have a finishing temperature of at least 870° C. The most preferred slab temperature of the invention of no more than about 1149° C. has practical application for thin continuously cast slabs having thicknesses of 25–50 mm. Additional cost savings are possible by casting a melt into thin slabs rather than thick slabs having a conventional thickness of 150 mm or more. By casting into a thin slab, time and energy for hot rolling to a sheet would be minimized. For example, a thin slab would require no or only minimal reduction using roughing stands. In addition to saving time and energy during rolling, further energy could be saved because the initial slab temperature could be considerably less than that required for thick slabs. Instead of at least 1260° C., thin slabs can be heated to as low as 1093° C. and still be satisfactorily hot rolled into a non-aging, batch annealed, aluminum killed steel having very a high $r_m$ value.

Various modifications can be made to the invention without departing from the spirit and scope of it. For example, the steel of the invention can be produced from continuously cast thin or thick slabs as well as thick slabs produced from ingots. Various reduced slab temperatures can be used so long as the hot rolling finishing temperature is above $Ar_3$ and the coiling temperature preferably is below 593° C. Therefore, the limits of the invention should be determined from the appended claims.

I claim:

1. An aluminum killed steel, comprising:

a cold reduced, recrystallization batch annealed, non-aging sheet characterized by an elongated grain structure and having an $r_m$ value of at least 1.8, said sheet consisting essentially of ≦0.08% carbon, ≦0.24% manganese, ≧0.01 acid sol. wt. % aluminum and nitrogen as an impurity, wherein the product of % acid sol. aluminum X % total nitrogen is no greater than about $5\times10^{-4}$, all percentages by weight, the balance iron and unavoidable impurities, said sheet having been produced from a slab having a hot rolling temperature less than about 1260° C. wherein said slab is hot rolled to a sheet having nitrogen in solution.

2. The steel of claim 1 wherein said sheet has 0.03–0.08% acid sol. aluminum and said $r_m$ value being at least 2.0.

3. The steel of claim 1 wherein said sheet has 0.003–0.007% total nitrogen and said $r_m$ value being at least 2.0.

4. The steel of claim 1 wherein said sheet has <0.20% manganese and said $r_m$ value being at least 2.0.

5. The steel of claim 1 wherein said sheet has a tensile strength of 29–32 kg/mm$^2$ and a total elongation of at least 42%.

6. The steel of claim 1 wherein said sheet has 0.05–0.06% acid sol. aluminum, 0.004–0.006% total nitrogen, the product of % acid sol. aluminum X % total nitrogen being in the range of $2\times10^{-4}$ to $4\times10^{-4}$ and said $r_m$ value being at least 2.0.

7. An aluminum killed steel, comprising:

a cold reduced, recrystallization batch annealed, non-aging sheet characterized by an elongated grain structure and having an $r_m$ value of at least 2.0, said sheet consisting essentially of ≦0.05% carbon, 0.03–0.08% acid sol. aluminum, 0.003–0.007% total nitrogen, ≦0.24% manganese, wherein the product of % acid sol. aluminum X % total nitrogen is no greater than about $5\times10^{-4}$, all percentages by weight, the balance iron and unavoidable impurities, said sheet having been produced from a continuously cast slab having a hot rolling temperature less than about 1175° C. wherein said slab is hot rolled to a sheet having nitrogen in solution.

8. An aluminum killed steel, comprising:

a cold reduced, recrystallization batch annealed, non-aging sheet characterized by an elongated grain structure and having an $r_m$ value of at least 2.0, said sheet consisting essentially of ≦0.05% carbon, 0.05–0.06% acid sol. aluminum, 0.004–0.006% total nitrogen, ≦0.24% manganese, wherein the product of % acid sol. aluminum and % total nitrogen is within the range of $2\times10^{-4}$ to $4\times10^{-4}$, all percentages by weight, the balance iron and unavoidable impurities, said sheet having been produced from a continuously cast slab having a hot rolling temperature less than about 1175° C. wherein said slab is hot rolled to a sheet having nitrogen in solution.

9. A method of producing an aluminum killed steel, comprising:

providing a slab consisting essentially of ≦0.08% carbon, ≦0.24% manganese, ≧0.01 acid sol. wt. % aluminum and nitrogen as an impurity, wherein the product of % acid sol. aluminum X % total nitrogen is no greater than about $5\times10^{-4}$, all percentages by weight, the balance iron and unavoidable impurities, hot rolling said slab having a hot rolling temperature less than about 1260° C. to a sheet having nitrogen in solution, coiling said hot rolled sheet, descaling said hot rolled sheet, cold reducing said descaled sheet, recrystallization batch annealing said cold reduced sheet wherein said annealed sheet is non-aging, characterized by an elongated grain structure and has an $r_m$ value of at least 1.8.

10. The method of claim 9 wherein said batch annealing is at a temperature no greater than 649° C.

11. The method of claim 9 wherein said batch annealing is at a temperature of at least 538° C.

12. The method of claim 9 wherein said slab has 0.003–0.08% acid sol. aluminum and said $r_m$ value being at least 2.0.

13. The method of claim 9 wherein said slab has 0.003–0.007% total nitrogen and said $r_m$ value being at least 2.0.

14. The method of claim 9 wherein said slab has <0.20% manganese and said $r_m$ value being at least 2.0.

15. The method of claim 9 wherein said slab has 0.05–0.06% acid sol. aluminum, 0.004–0.006% total nitrogen, the product of % acid sol. aluminum X % total nitrogen being in the range of $2\times10^{-4}$ to $4\times10^{-4}$ and said $r_m$ value being at least 2.0.

16. The method of claim 9 wherein said batch annealed sheet has a tensile strength of 29–32 kg/mm$^2$ and a total elongation of at least 42%.

17. The method of claim 9 wherein said slab is continuously cast to a thickness of about 25–50 mm.

18. The method of claim 9 including the additional steps of cooling said slab to a temperature less than about $Ar_3$ to precipitate aluminum nitride, reheating said slab to a temperature less than 1260° C. prior to said hot rolling to redissolve said aluminum nitride.

19. A method of producing an aluminum killed steel, comprising: providing a melt consisting essentially of ≦0.05% carbon, 0.03–0.08% acid sol. aluminum, 0.003–0.007% total nitrogen, <0.24% manganese, wherein the product of % acid sol. aluminum X % total nitrogen is no greater than about $5\times10^{-4}$, all percentages by weight, the balance iron and unavoidable impurities, casting said melt into a slab, cooling said slab to a temperature below $Ar_3$ to precipitate aluminum nitride, reheating said slab to a temperature less than 1175° C. to redissolve said aluminum nitride, hot rolling said slab to a sheet having nitrogen in solution, coiling said hot rolled sheet, descaling said hot rolled sheet, cold reducing said descaled sheet, recrystallization batch annealing said cold reduced sheet wherein said annealed sheet is non-aging, characterized by an elongated grain structure and has an $r_m$ value of at least 2.0.

20. A method of producing an aluminum killed steel, comprising:

providing a melt consisting essentially of ≦0.05% carbon, 0.05–0.06% acid sol. aluminum, 0.004–0.006% total nitrogen, ≦0.24% manganese, wherein the product of % acid sol. aluminum X % total nitrogen is within the range of $2\times10^{-4}$ to $4\times10^{-4}$, all percentages by weight, the balance iron and unavoidable impurities, casting said melt into a slab, cooling said slab to a temperature below $Ar_3$ to precipitate aluminum nitride, reheating said slab to the temperature less than 1175° C. to redissolve said aluminum nitride, hot rolling said slab to a sheet having a finishing temperature at least equal to $Ar_3$, coiling said hot rolled sheet at a temperature no greater than 593° C. wherein said sheet has nitrogen in solution, descaling said hot rolled sheet, cold reducing said descaled sheet, recrystallization batch annealing said cold reduced sheet in the range of 538°–649° C. wherein said annealed sheet is non-aging, characterized by an elongated grain structure and has an $r_m$ value of at least 2.0.

21. A method of producing an aluminum killed steel, comprising:

providing a melt consisting essentially of ≦0.08% carbon, ≦0.24% manganese, ≧0.01 acid sol. wt. % aluminum and nitrogen as an impurity wherein the product of % acid sol. aluminum X % total nitrogen is no greater than about $5\times10^{-4}$, all percentages by weight, the balance iron and unavoidable impurities, continuously casting said melt to a slab having a thickness of 25–50 mm, cooling said slab to a temperature below $Ar_3$ to precipitate aluminum nitride, reheating said slab to the temperature less than 1175° C. to redissolve said aluminum nitride, hot rolling said slab to a sheet having nitrogen in solution, coiling said hot rolled sheet, descaling said hot rolled sheet, cold reducing said descaled sheet, recrystallization batch annealing said cold reduced sheet wherein said annealed sheet is non-aging, characterized by an elongated grain structure and has an $r_m$ value of at least 2.0.

* * * * *